US009702621B2

(12) United States Patent
Cho et al.

(10) Patent No.: US 9,702,621 B2
(45) Date of Patent: Jul. 11, 2017

(54) REFRIGERATOR AND DISPLAY UNIT OF REFRIGERATOR

(71) Applicant: Samsung Electronics Co., Ltd., Gyeonggi-do (KR)

(72) Inventors: Woo Chul Cho, Gyeonggi-do (KR); Sang Cheol Lee, Gyeonggi-do (KR); Jong Sun Park, Gyeonggi-do (KR); Sang-Jin Lee, Gyeonggi-do (KR); Sang Gyu Jung, Gyeonggi-do (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/988,652

(22) Filed: Jan. 5, 2016

(65) Prior Publication Data

US 2016/0209110 A1 Jul. 21, 2016

(30) Foreign Application Priority Data

Jan. 5, 2015 (KR) ..... 10-2015-0000408

(51) Int. Cl.
*A47B 96/04* (2006.01)
*F25D 29/00* (2006.01)
(Continued)

(52) U.S. Cl.
CPC ..... *F25D 29/005* (2013.01); *F25D 23/028* (2013.01); *F25D 23/062* (2013.01); *F25D 25/02* (2013.01); *F25D 2400/361* (2013.01)

(58) Field of Classification Search
CPC ..... F25D 2400/36; F25D 2400/361; F25D 29/005; F25D 23/028; F25D 23/062; F25D 25/02
(Continued)

(56) References Cited

U.S. PATENT DOCUMENTS 4,966,004 A * 10/1990 Midlang ..... F25D 29/005 200/302.2
5,758,200 A * 5/1998 Inoue ..... G03B 17/08 396/25
(Continued)

FOREIGN PATENT DOCUMENTS

| | | |
|---|---|---|
| JP | 2002-31471 | 2/2002 |
| JP | 2004-347238 A | 12/2004 |
| KR | 2001-0037542 A | 5/2001 |

OTHER PUBLICATIONS

Extended European Search Report dated May 13, 2016 in connection with European Application No. 15203185.2, 7 pages.

*Primary Examiner* — Daniel J Troy
*Assistant Examiner* — Timothy M Ayres

(57) ABSTRACT

Disclosed herein are a refrigerator and a display unit of the refrigerator, in which a sealing member is disposed between a display installation part and a displaying part of a display unit, and thus moisture is prevented from penetrating into the display unit. The refrigerator includes a door assembly which opens and closes an opened front surface of a storage compartment and including an opening provided at a front surface thereof, and a display unit, wherein the display unit includes a display installation part that is inside the door assembly to correspond to the opening and at which a display is installed, a displaying part which is disposed at a front surface of the display installation part and exposed to an outside through the opening, and a sealing member which seals between the display installation part and the displaying part and prevents moisture from penetrating into the display unit.

15 Claims, 34 Drawing Sheets

(51) Int. Cl.
*F25D 23/02* (2006.01)
*F25D 23/06* (2006.01)
*F25D 25/02* (2006.01)

(58) Field of Classification Search
USPC ..... 312/242
See application file for complete search history.

(56) References Cited

U.S. PATENT DOCUMENTS

| | | | | |
|---|---|---|---|---|
| 8,220,204 | B2 * | 7/2012 | Lee | F25D 23/02 312/405 |
| 8,783,801 | B2 * | 7/2014 | Kaplan | F25D 23/028 312/204 |
| 9,069,201 | B2 * | 6/2015 | Pipitone | G02F 1/133308 |
| 2014/0043844 | A1 | 2/2014 | Yang et al. | |
| 2014/0300263 | A1 * | 10/2014 | Sung | G06F 3/044 312/404 |
| 2015/0052920 | A1 * | 2/2015 | Park | F25D 29/005 62/126 |

* cited by examiner

REFRIGERATOR AND DISPLAY UNIT OF REFRIGERATOR

CROSS-REFERENCE TO RELATED APPLICATION AND CLAIM OF PRIORITY

The present application is related to and claims benefit of Korean Patent Application No. 10-2015-0000408, filed on Jan. 5, 2015 in the Korean Intellectual Property Office, the disclosure of which is incorporated herein by reference.

TECHNICAL FIELD

Embodiments of the present disclosure relate to a refrigerator having an improved coupling structure of a display unit and the display unit of the refrigerator.

BACKGROUND

In general, a refrigerator is an apparatus which includes a main body including an internal structure and an external structure, a storage compartment in which the internal structure is formed, and a cooling air supply unit which supplies cooling air to the storage compartment and keeps food fresh.

A temperature of the storage compartment is maintained within a predetermined range which is required to keep the food fresh.

Such a storage compartment of the refrigerant is provided so that a front surface thereof is opened, and the opened front surface is closed by a door to maintain the temperature of the storage compartment.

The storage compartment is divided by a partition wall into an upper storage compartment and a lower storage compartment that is a freezer compartment, and the refrigerator compartment and the freezer compartment are opened and closed by a refrigerator compartment door and a freezer compartment door, respectively.

A display unit which displays operation information of the refrigerator or receives an operation command of the refrigerator is provided at the refrigerator compartment door.

The display unit includes a display installation part at which a display is installed and a displaying part which is disposed at a front surface of the display installation part.

Since an inside of the refrigerator compartment has a temperature lower than that of an outside, dew may form on a surface of the refrigerator compartment door due to a heat exchange due to a temperature difference between the inside and the outside of the refrigerator compartment, and to prevent the dew, an insulation thickness of the refrigerator compartment door needs to be thick.

Alternatively, instead of increasing the insulation thickness of the refrigerator compartment door, a vacuum insulation material may be provided inside the refrigerator compartment door. However, the vacuum insulation material may cause an increase in cost.

Since a portion of the refrigerator compartment door at which the display unit is provided necessarily has an insulation thickness thinner than that of other portions, either the vacuum insulation material should be provided therein to cover the thin insulation thickness, or a rear wall of a portion of the refrigerator compartment door at which the display unit is provided should protrude backward to have the same insulation thickness as that of other portions.

However, when the vacuum insulation material is used, the cost is increased, and when the rear wall of the refrigerator compartment door protrudes backward, a shape of a door guard provided at the rear wall of the refrigerator compartment door should be modified.

SUMMARY

To address the above-discussed deficiencies, it is a primary object to provide a refrigerator and a display unit of the refrigerator in which a sealing member is disposed between a display installation part and a displaying part of the display unit to prevent moisture from penetrating into the display unit.

Additional aspects of the disclosure will be set forth in part in the description which follows and, in part, will be obvious from the description, or may be learned by practice of the disclosure.

In accordance with one aspect of the present disclosure, a refrigerator includes a main body; a storage compartment inside the main body so that a front surface thereof is opened; a door assembly rotatably coupled to the main body to open and close the opened front surface of the storage compartment and including an opening provided at a front surface thereof; and a display unit provided at the door assembly, wherein the display unit includes a display installation part that is inside the door assembly to correspond to the opening and at which a display is installed, a displaying part that is disposed at a front surface of the display installation part and exposed to an outside through the opening, and a sealing member that seals between the display installation part and the displaying part and is configured to prevent moisture from penetrating into the display unit.

The door assembly may include a door plate that forms a front surface and side surfaces of the door plate and a rear plate that forms a rear surface of the door plate, and an insulation material is filled between the door plate and the rear plate.

The opening may be provided at a front surface of the door plate, and a coupling portion that is bent toward an inside of the door plate and to which the display installation part and the displaying part are coupled may be provided at an edge of the opening.

The display installation part may include a plurality of coupling ribs that is coupled to the coupling portion, and a close contact portion that is in close contact with a rear surface of the door plate and is configured to prevent the insulation material from penetrating into the display installation part.

The plurality of coupling ribs may be provided at both sides of the display installation part, and a plurality of first coupling holes to which the plurality of coupling ribs are coupled may be provided at both side surfaces of the coupling portion.

The displaying part may include a plurality of coupling hooks that are coupled to the coupling portion and a seating groove in which the sealing member is seated.

The coupling hook may include a first coupling hook that is provided at each of upper and lower portions of the displaying part and a plurality of second coupling hooks that are provided at both side surfaces of the displaying part.

The first coupling hook may be coupled to upper and lower portions of the coupling portion, and a plurality of second coupling holes to which the second coupling hooks are coupled may be provided at both side surfaces of the coupling portion.

A protruding rib that is provided corresponding to the seating groove may be provided at the display installation part, and when the display installation part and the displaying part are coupled to the coupling portion, the protruding rib may press the sealing member while being inserted into the seating groove, and the sealing member may seal between the protruding rib and the seating groove.

In accordance with another aspect of the present disclosure, a display unit that is provided at a door assembly for opening and closing a storage compartment of a refrigerator includes a display installation part provided inside the door assembly and at which a display is installed; a displaying part disposed at a front surface of the display installation part to be exposed to a front surface of the door assembly; and a sealing member configured to seal between the display installation part and the displaying part and to prevent moisture from penetrating into the display unit.

The door assembly may include a door plate that comprises a front plate including an opening and a side plate that is bent backward from the front surface, and a rear plate which forms a rear surface of the door plate, and the display installation part and the displaying part may be coupled to a coupling portion provided at an edge of the opening.

The display installation part may include a plurality of coupling ribs that are coupled to the coupling portion and a close contact portion that is in close contact with a rear surface of the front plate and is configured to prevent an insulation material filled in the door assembly from penetrating into the display installation part.

The plurality of coupling ribs may be provided at both sides of the display installation part, and a plurality of first coupling holes to which the plurality of coupling ribs are coupled may be provided at both side surfaces of the coupling portion.

The displaying part may include a plurality of coupling hooks that are exposed to an outside through the opening and coupled to the coupling portion and a seating groove in which the sealing member is seated.

The coupling hook may include a first coupling hook that is provided at each of upper and lower portions of the displaying part and a plurality of second coupling hooks that are provided at both side surfaces of the displaying part.

The first coupling hook may be coupled to upper and lower portions of the coupling portion, and a plurality of second coupling holes to which the second coupling hooks are coupled may be provided at both side surfaces of the coupling portion.

A protruding rib that is provided corresponding to the seating groove may be provided at the display installation part, and when the display installation part and the displaying part are coupled to the coupling portion, the protruding rib may press the sealing member while being inserted into the seating groove, and the sealing member may seal between the protruding rib and the seating groove.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which: For a more complete understanding of the present disclosure and its advantages, reference is now made to the following description taken in conjunction with the accompanying drawings, in which like reference numerals represent like parts:

FIG. 17 is seen from another direction according to one embodiment of the present disclosure;

DETAILED DESCRIPTION

Figure 1:
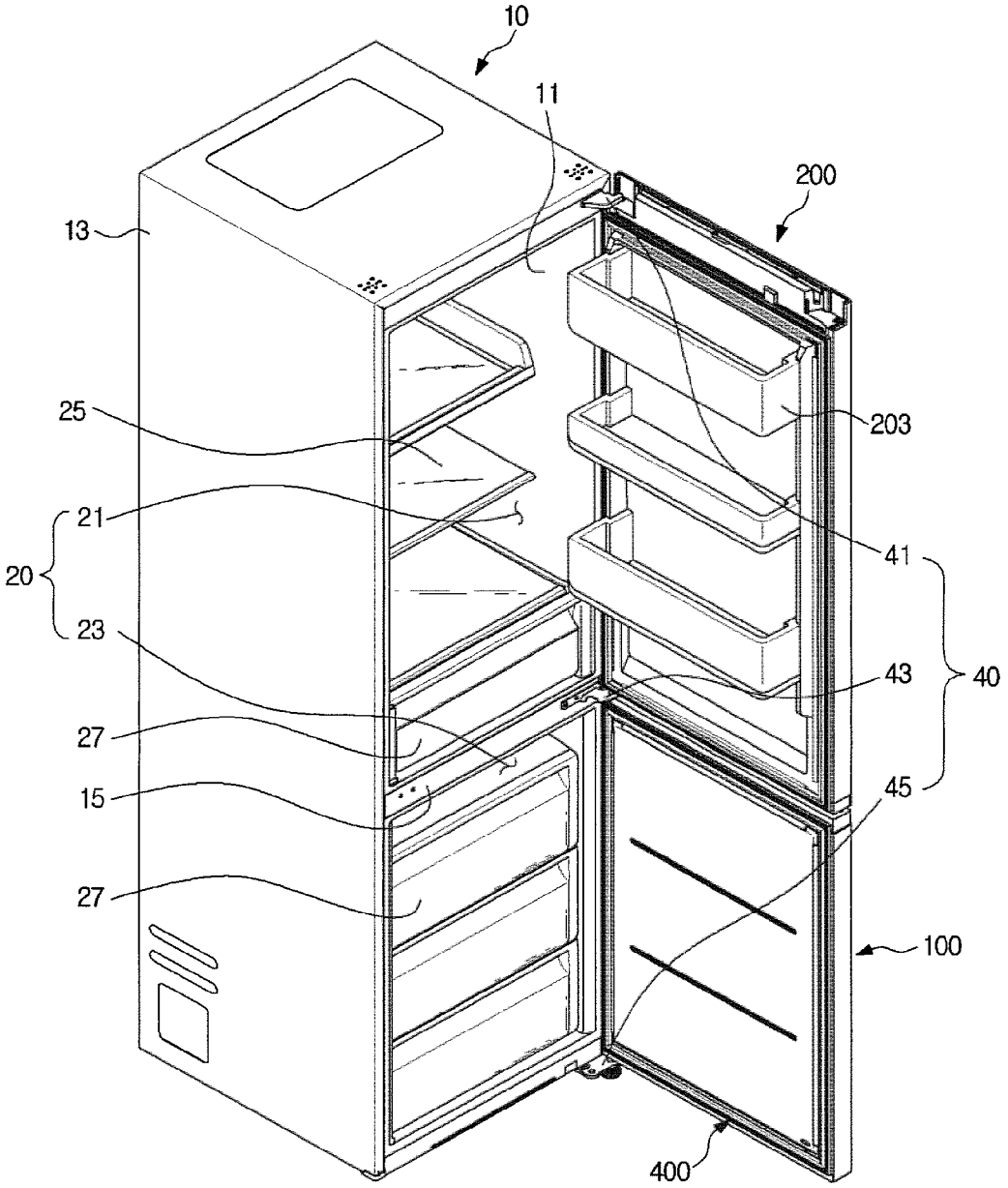
FIG. 1 is a perspective view of a refrigerator according to one embodiment of the present disclosure.

FIGS. 1 through 34, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. Reference will now be made in detail to the embodiments of the present disclosure, examples of which are illustrated in the accompanying drawings, wherein like reference numerals refer to like elements throughout.

In the drawings, a "front" is a direction from a rear surface of a refrigerator toward a front surface thereof, and a "rear" is a direction from the front surface of the refrigerator toward the rear surface thereof.

Figure 2:
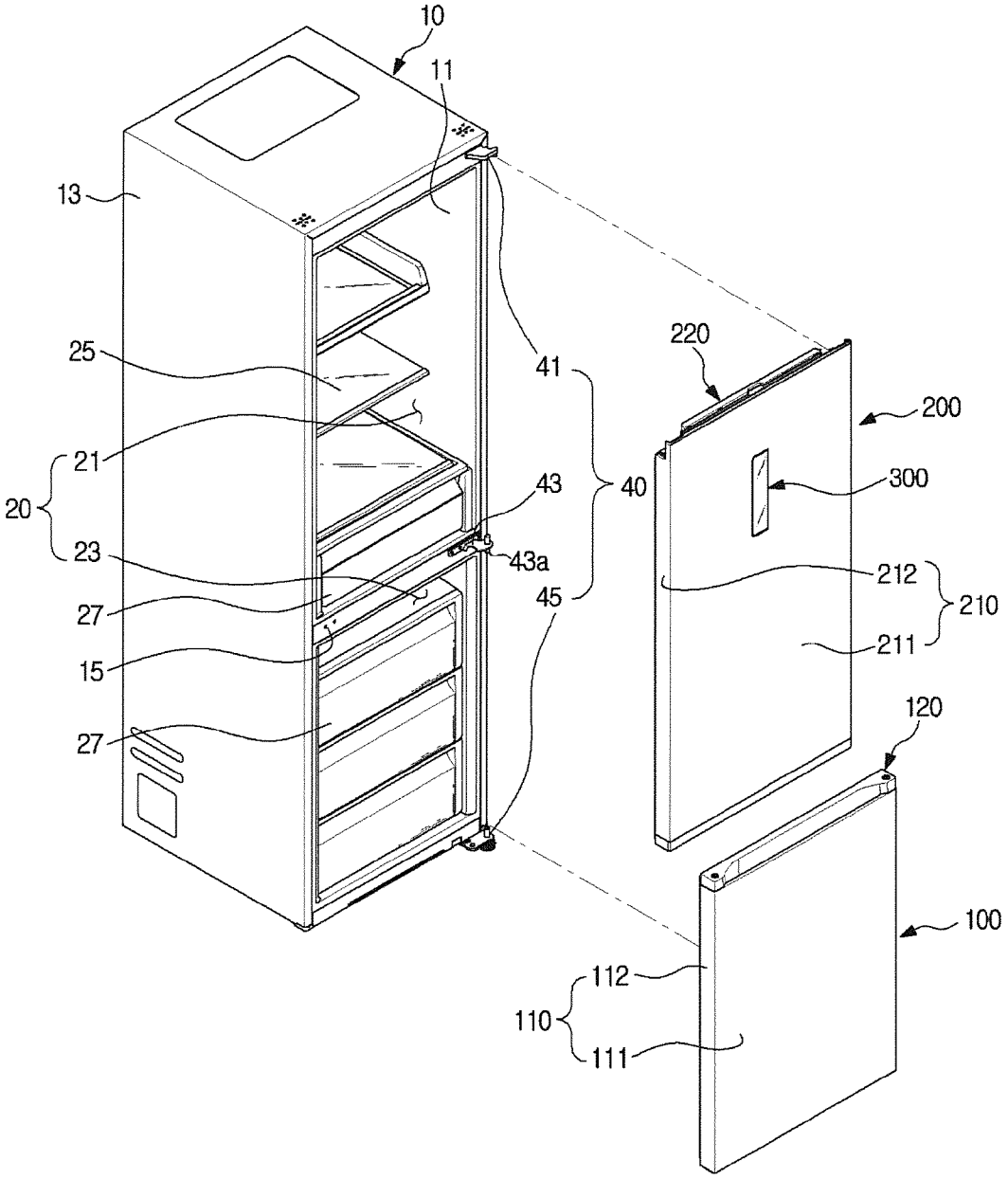
FIG. 2 is a view illustrating a state in which a door assembly of the refrigerator is separated according to one embodiment of the present disclosure.

As illustrated in FIGS. 1 to 2, a refrigerator includes a main body 10, a storage compartment 20 which is provided inside the main body 10 such that a front surface thereof is open and door assemblies 100 and 200 which are rotatably coupled to the main body 10 to open and close the open front surface of the storage compartment 20.

The main body 10 includes an internal structure 11 which forms the storage compartment 20, an external structure 13 which is coupled to an outside of the internal structure 11 and forms an exterior, and a cooling air supplying device (not shown) which supplies cooling air to the storage compartment 20.

The cooling air supplying device may include a compressor, a condenser, an expansion valve, an evaporator, a fan, a cool air duct and so on, and an insulation material (not shown) is filled between the internal structure 11 and the external structure 13 to prevent the cool air in the storage compartment 20 from leaking.

A mechanical compartment (not shown) in which the compressor and the condenser compressing a refrigerant and condensing the compressed refrigerant respectively are installed may be provided at a lower side of a rear of the main body 10.

The storage compartment 20 may be divided into a refrigerator compartment 21 as an upper storage compartment and a freezer compartment 23 as a lower storage compartment by a partition wall 15, and a plurality of shelves 25 on which food or the like is stacked and stored may be provided therein and divide an inside of the refrigerator compartment 21 or the freezer compartment 23 into a plurality of areas.

Also, a storage container 27 which accommodates and stores the food or the like may be provided inside the storage compartment 20.

The storage compartment 20 may be opened and closed by the door assemblies 100 and 200 which are rotatably coupled to the main body 10, and a plurality of door guards 203 which store the food or the like may be installed at a rear surface of the door assembly 200.

Each of the door assemblies 100 and 200 may be rotatably coupled to the main body 10 by a hinge unit 40, and the hinge unit 40 may include an upper hinge 41, a middle hinge 43 and a lower hinge 45.

A gasket 400 which maintains an airtight state between the main body 10 and the door assemblies 100 and 200 and prevents the cool air in the storage compartment 20 from leaking to an outside while the door assemblies 100 and 200 are closed is provided at a rear surface of each of the door assemblies 100 and 200.

The door assemblies 100 and 200 include a freezer compartment door assembly 100 which opens and closes the freezer compartment 23 which is the lower storage compartment, and a refrigerator compartment door assembly 200 which opens and closes the refrigerator compartment 21 which is the upper storage compartment.

Figure 3:
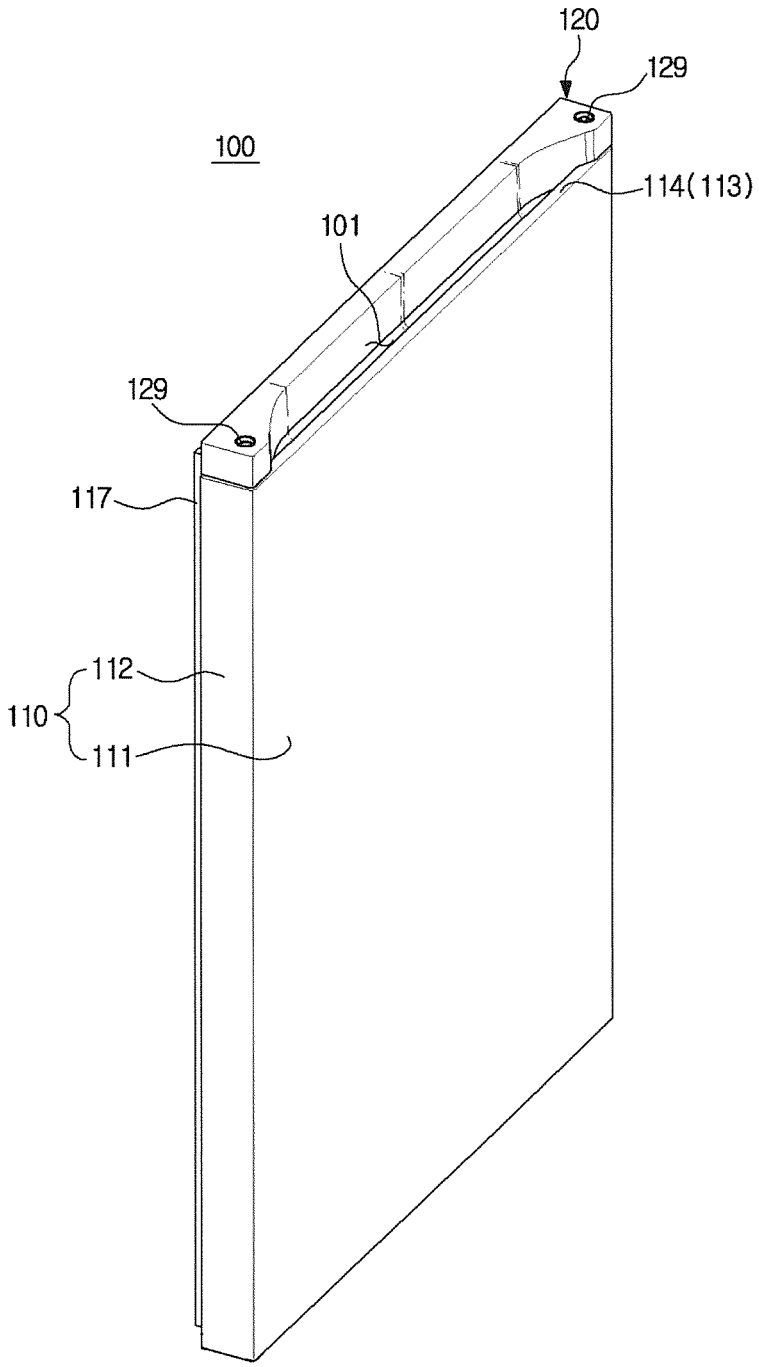
FIG. 3 is a perspective view of a freezer compartment door assembly according to one embodiment of the present disclosure.
Figure 4:
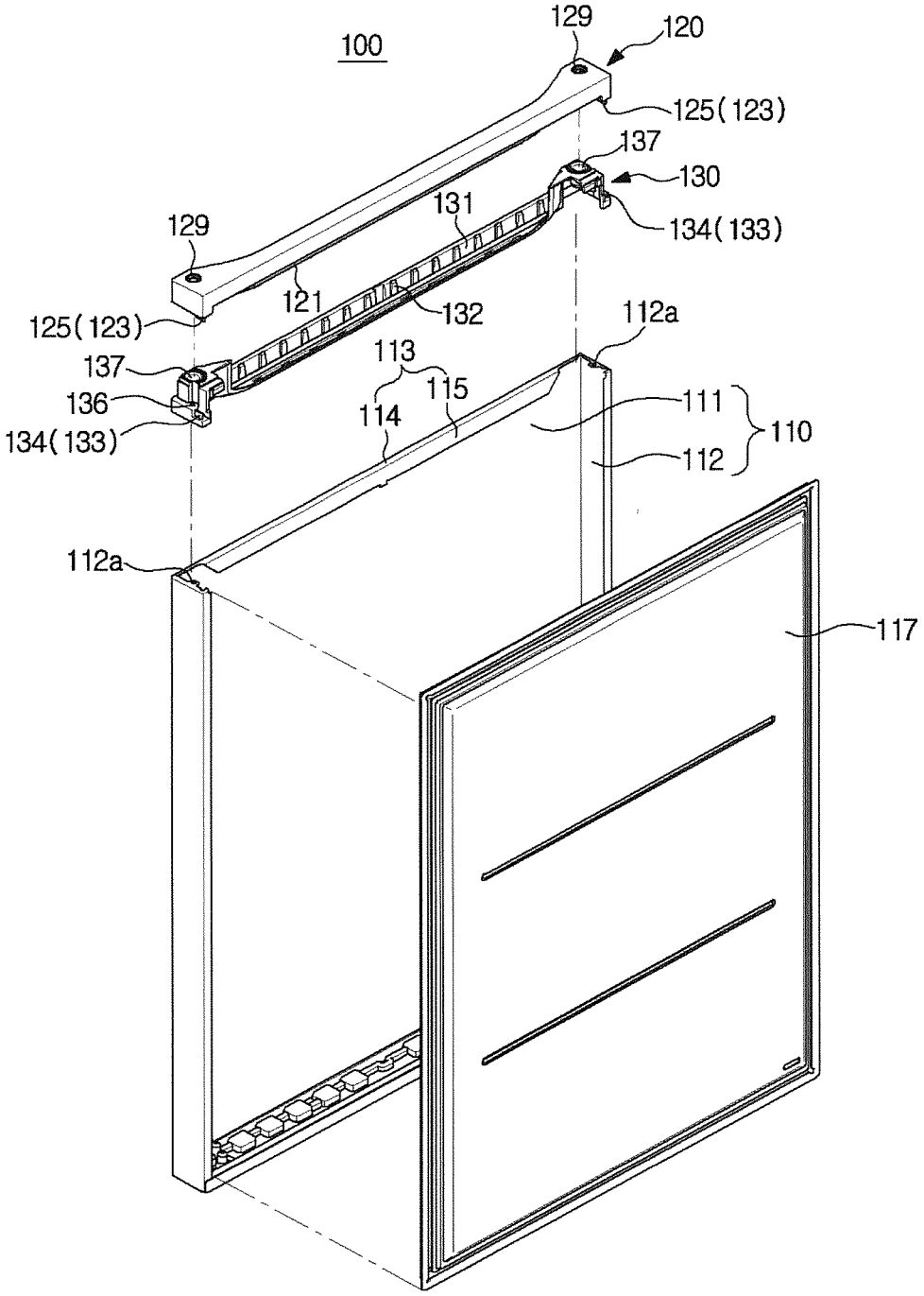
FIG. 4 is an exploded perspective view of the freezer compartment door assembly according to one embodiment of the present disclosure.
Figure 5:
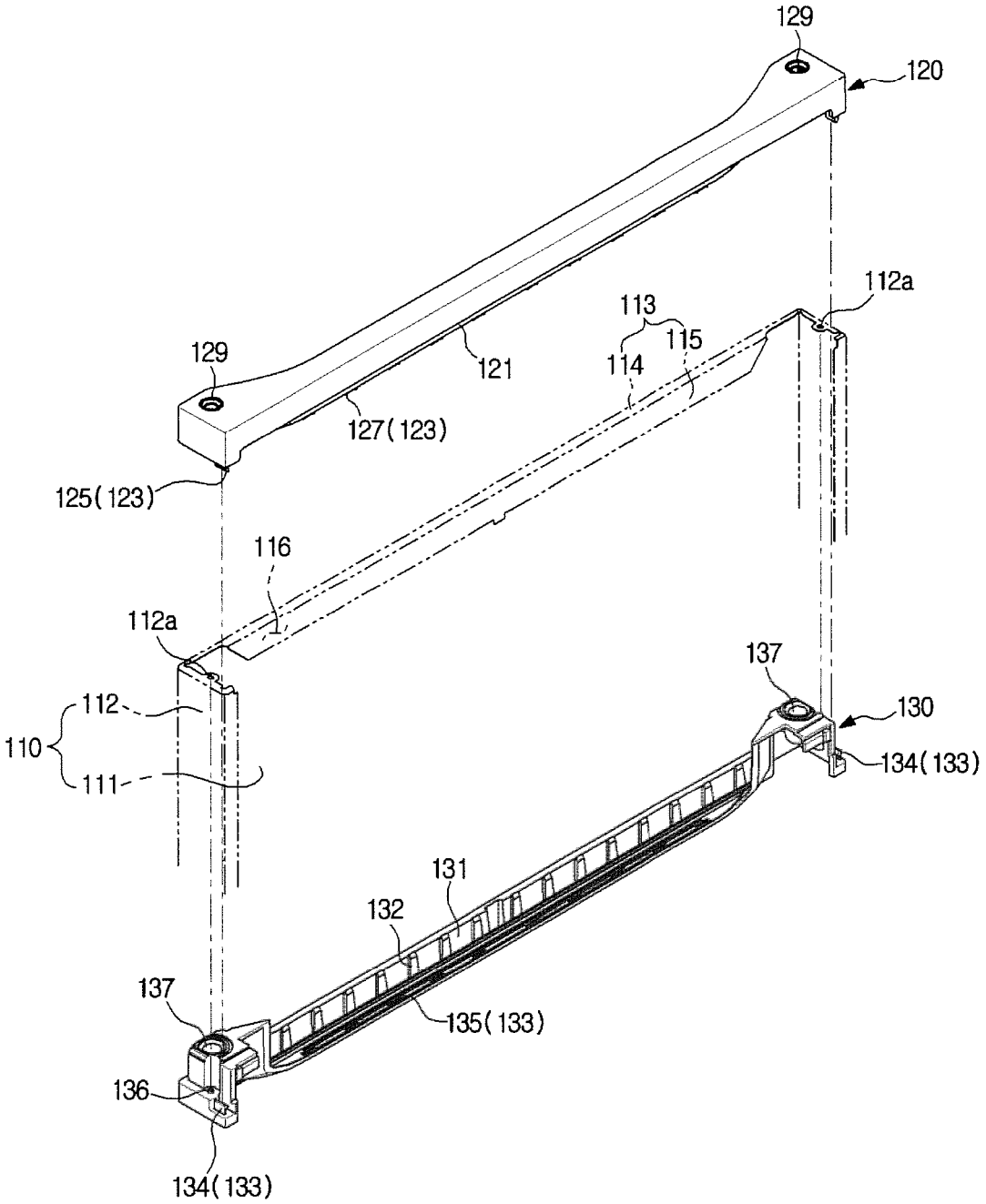
FIG. 5 is a view of a door plate, a door cap, and a door cap supporting part according to one embodiment of the present disclosure.

As illustrated in FIGS. 3 to 5, the freezer compartment door assembly 100 which opens and closes the freezer compartment 23 includes a door plate 110 which forms a front surface and side surfaces of the freezer compartment door assembly 100, a door cap 120 which covers an upper portion of the door plate 110, and a door cap supporting part 130 which is fixed to the door plate 110 so that the door cap 120 is provided at the upper portion of the door plate 110 and supports the door cap 120.

The door plate 110 includes a front plate 111 which forms a front surface of the freezer compartment door assembly 100 and side plates 112 which are provided to be bent backward from both sides of the front plate 111 and form the side surfaces of the freezer compartment door assembly 100. A rear plate 117 is coupled to a rear surface of the door plate 110 and forms a rear surface of the freezer compartment door assembly 100.

A bent portion 113 and fixing holes 112*a* to which the door cap supporting part 130 is fixed are provided at an upper end of each of the front plate 111 and the side plates 112.

The bent portion 113 includes a first bent portion 114 which is formed backward at the upper end of the front plate 111 to be bent vertically to the front plate 111 and a second bent portion 115 which is formed downward at an end of the first bent portion 114 to be bent vertically to the first bent portion 114.

Therefore, a fixing groove 116 which is opened downward is provided between the front plate 111 and the second bent portion 115, and the door cap supporting part 130 is inserted into the fixing groove 116 from a lower side of the fixing groove 116 toward an upper side thereof and fixed to the fixing groove 116.

The door cap 120 is not directly coupled to the door plate 110 but is coupled to the door cap supporting part 130 fixed to the upper portion of the door plate 110 and covers the upper portion of the door plate 110.

The door cap supporting part 130 includes an inserting portion 131 which is inserted into the fixing groove 116, a plurality of protruding ribs 132 which are provided to protrude from a rear surface of the inserting portion 131, and a coupling portion 133 to which the door cap 120 is coupled.

When the inserting portion 131 of the cap supporting part 130 is inserted into the fixing groove 116, the plurality of protruding ribs 132 provided at the inserting portion 131 are in close contact with the second bent portion 115, and thus the door cap supporting part 130 is fixed to the door plate 110.

The drawings have illustrated an example in which the protruding ribs 132 are provided at the rear surface of the inserting portion 131 to be in close contact with the second bent portion 115, however, the protruding ribs 132 may be provided at a front surface of the inserting portion 131 to be in close contact with the front plate 111 of the door plate 110.

Also, a fixing protrusion 136 which is fixed to the fixing holes 112*a* of the side plates 112 when the inserting portion 131 is fixed to the fixing groove 116 may be provided at the door cap supporting part 130.

A plurality of coupling portions 133 to which the door cap 120 is fixed are provided and includes a coupling protrusion 134 which is provided at a position corresponding to a first coupling hook 125 of the door cap 120 which will be described below and to which the first coupling hook 125 is coupled and a coupling hole 135 which is provided at a position corresponding to a second coupling hook 127 and to which the second coupling hook 127 is coupled.

The door cap 120 includes a recessed portion 121 which covers the upper portion of the door plate 110 and is recessed downward to provide a gripping groove 101 between the door plate 110 and the bent portion 113 and a plurality of coupling hooks 123 which are coupled to the door cap supporting part 130.

When the door cap 120 is coupled to the door cap supporting part 130, the gripping groove 101 is provided between the recessed portion 121 of the door cap 120 and the bent portion 113 of the door plate 110, and the gripping groove 101 serves as a handle which is gripped by a user to open and close the freezer compartment door assembly 100.

Therefore, when the user opens and closes the freezer compartment door assembly 100, the user inserts his/her hand into the gripping groove 101, grips the bent portion 113, and then opens and closes the freezer compartment door assembly 100.

The coupling hooks 123 include a first coupling hook 125 which is provided at each of both sides of the door cap 120 and a plurality of second coupling hooks 127 which are provided at a lower portion of the recessed portion 121.

When the door cap 120 is coupled to the door cap supporting part 130, the first coupling hook 125 is coupled to the coupling protrusion 134 of the door cap supporting part 130, and the second coupling hooks 127 are coupled to the coupling holes 135 of the door cap supporting part 130.

The coupling holes 135 of the door cap supporting part 130 are provided at a rear of the inserting portion 131 inserted into the fixing groove 116, and thus a portion at which the second coupling hook 127 of the door cap 120 is coupled to the coupling hole 135 of the door cap supporting part 130 is covered by the door plate 110 and is not exposed to a front surface when the door cap 120 is coupled to the door cap supporting part 130.

Since the portion at which the door cap 120 is coupled to the door cap supporting part 130 is not exposed to the front surface of the refrigerator, the external appearance becomes simplified and may result in a good design and also foreign substances may be prevented from entering through a gap of the portion at which the door cap 120 is coupled to the door cap supporting part 130.

A hinge hole 129 in which a hinge shaft 43*a* of the middle hinge 43 is rotatably inserted may be provided at each of both ends of the door cap 120, and a hinge groove 137 in which the hinge shaft 43*a* is rotatably inserted may be provided at each of both ends of the door cap supporting part 130.

The drawings have illustrated an example in which the middle hinge 43 is provided at a right side of the main body 10. However, since the hinge hole 129 and the hinge groove 137 are provided at both ends of each of the door cap 120 and the door cap supporting part 130, the freezer compartment door assembly 100 may be applied regardless of a position at which the middle hinge 43 is provided.

Then, a coupling operation of the door plate 110, the door cap 120 and the door cap supporting part 130 of the freezer compartment door assembly 100 will be described with reference to FIGS. 6 to 12.

Figure 6:
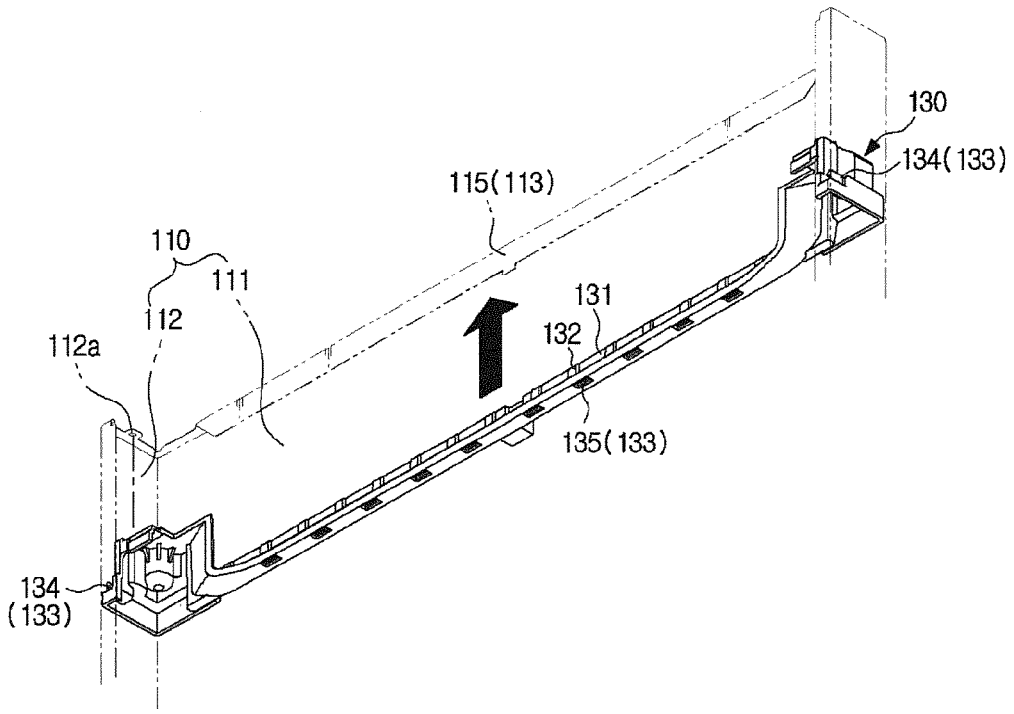
FIG. 6 is a view illustrating a state in which the door cap supporting part is fixed to the door plate according to one embodiment of the present disclosure.
Figure 7:
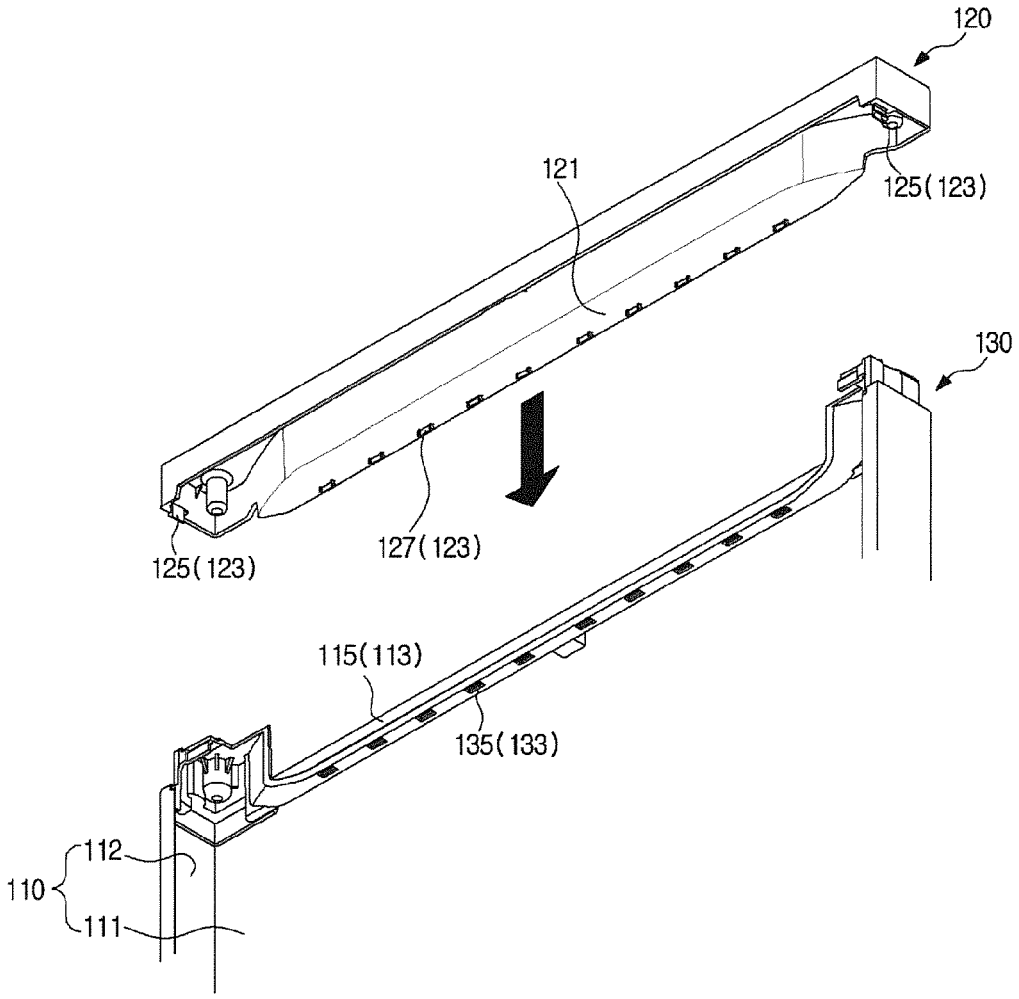
FIG. 7 is a view illustrating a state in which the door cap is coupled to the door cap supporting part according to one embodiment of the present disclosure.

As illustrated in FIGS. 6 and 7, the door cap supporting part 130 is moved from a lower side toward an upper side, and the inserting portion 131 is inserted into the fixing groove 116 which is opened downward, and the plurality of protruding ribs 132 which are provided at the rear surface of the inserting portion 131 to protrude are in close contact with the second bent portion 115 so that the door cap supporting part 130 is fixed to the door plate 110.

Also, when the inserting portion 131 is inserted into the fixing groove 116, the fixing protrusions 136 provided at both sides of the door cap supporting part 130 are inserted into the fixing holes 112*a* provided at the side plates 112, and thus the door cap supporting part 130 is fixed to the door plate 110.

When the door cap supporting part 130 is fixed to the door plate 110, the door cap 120 is moved from the upper side toward the lower side, and thus the door cap 120 is coupled to the door cap supporting part 130.

Figure 8:
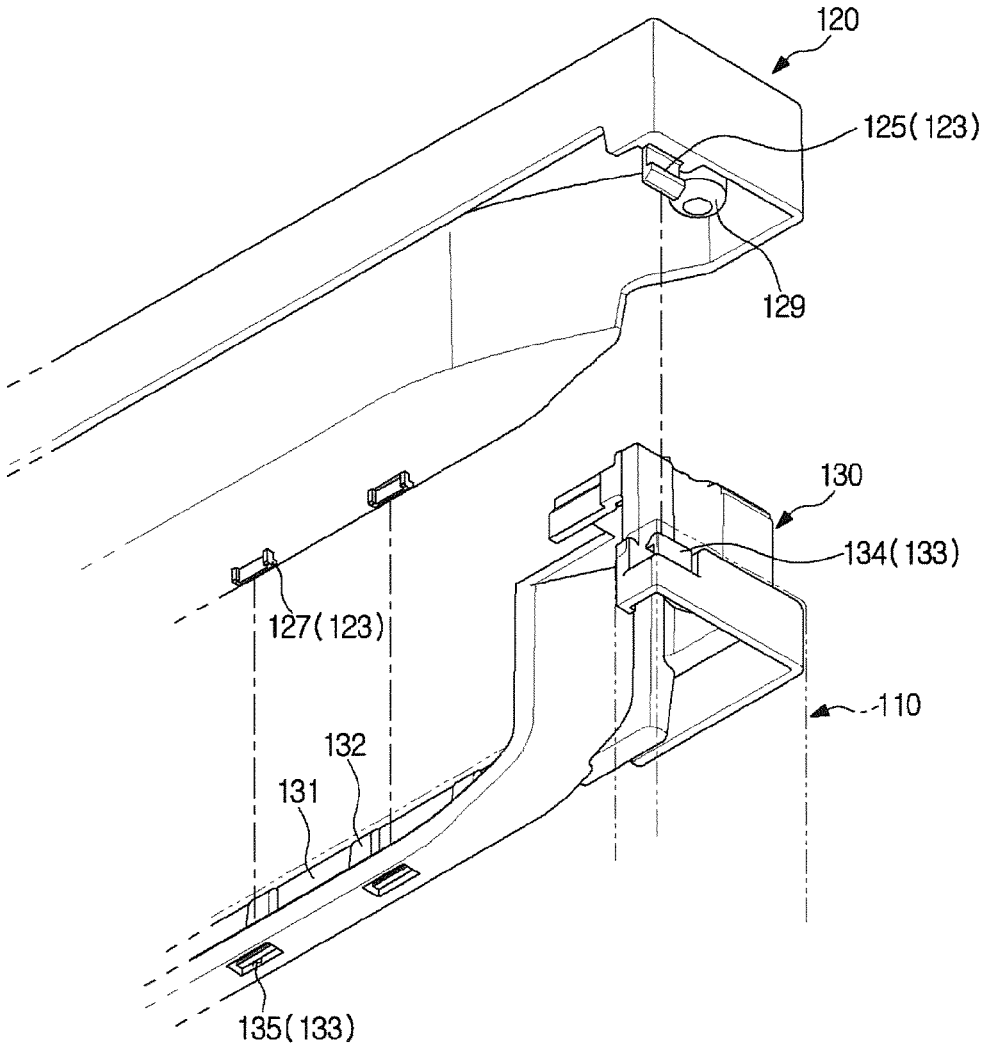
FIG. 8 is a view illustrating a state in which a first coupling hook and a second coupling hook of the door cap are coupled to a coupling protrusion and a coupling hole of the door cap supporting part, respectively, according to one embodiment of the present disclosure.

As illustrated in FIG. 8, the door cap 120 enables the first coupling hook 125 and the second coupling hooks 127 provided at the door cap 120 to correspond to the coupling protrusion 134 and the coupling holes 135 and thus is coupled to the door cap supporting part 130.

Figure 9:
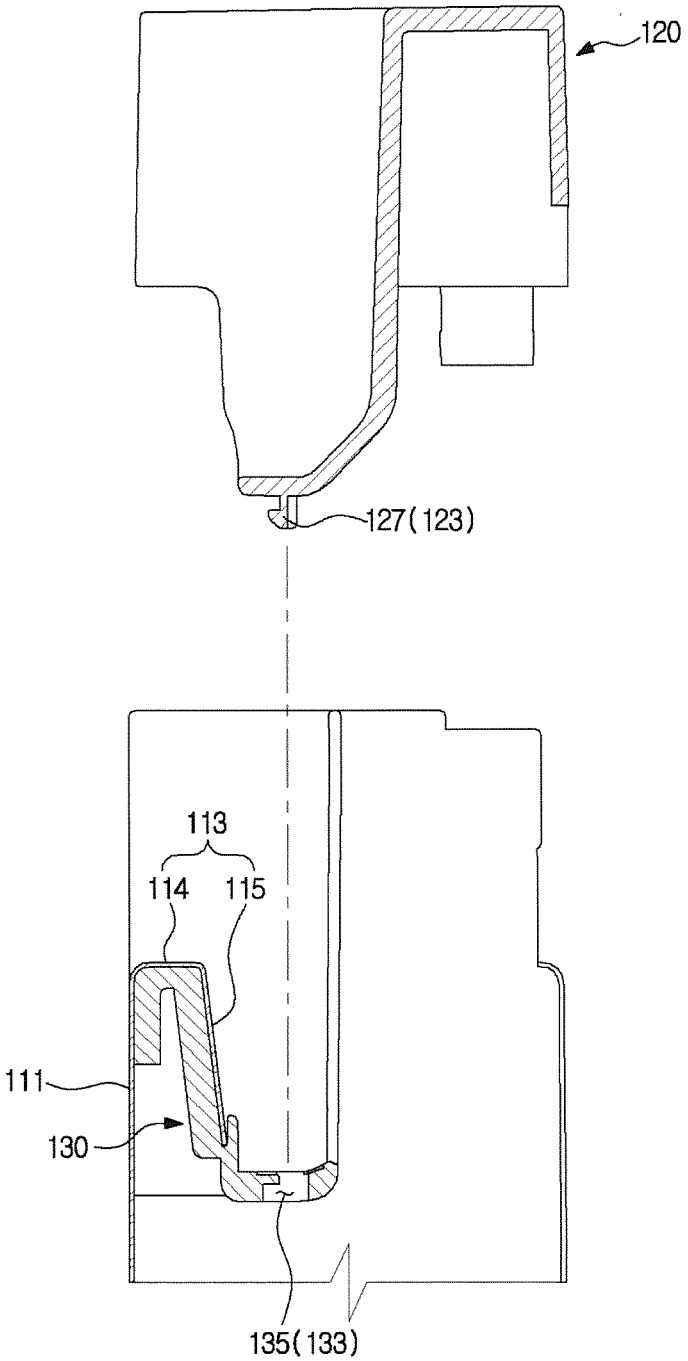
FIGS. 9 and 10 are views illustrating a state in which the second coupling hook of the door cap is coupled to the coupling hole of the door cap supporting part according to one embodiment of the present disclosure.
Figure 10:
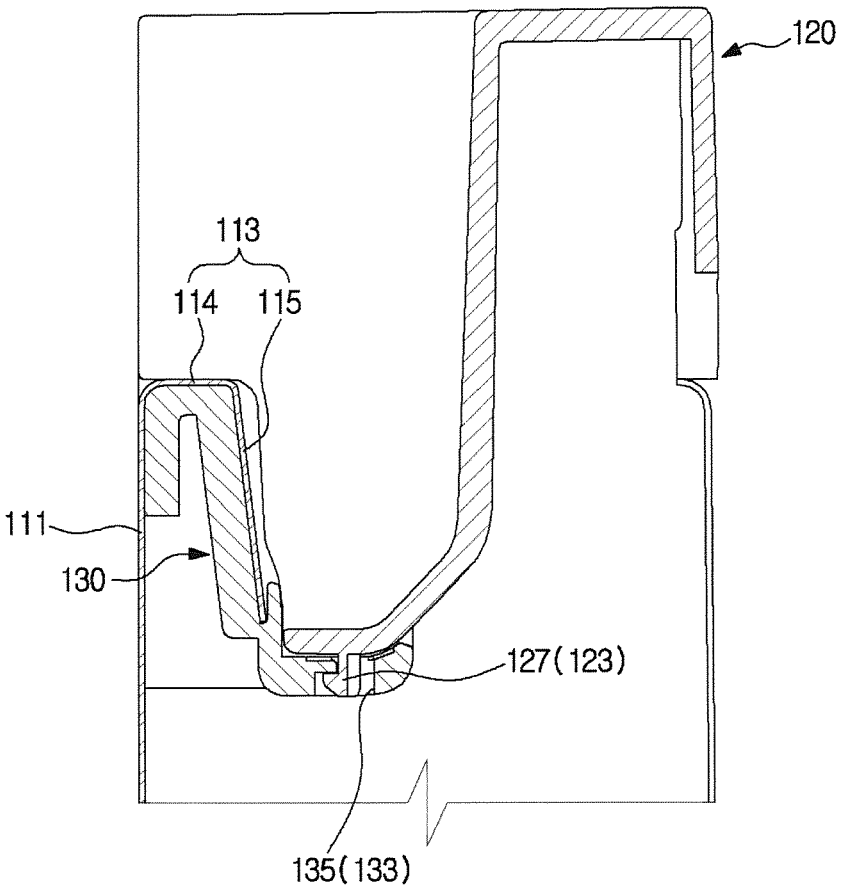
Figure 11:
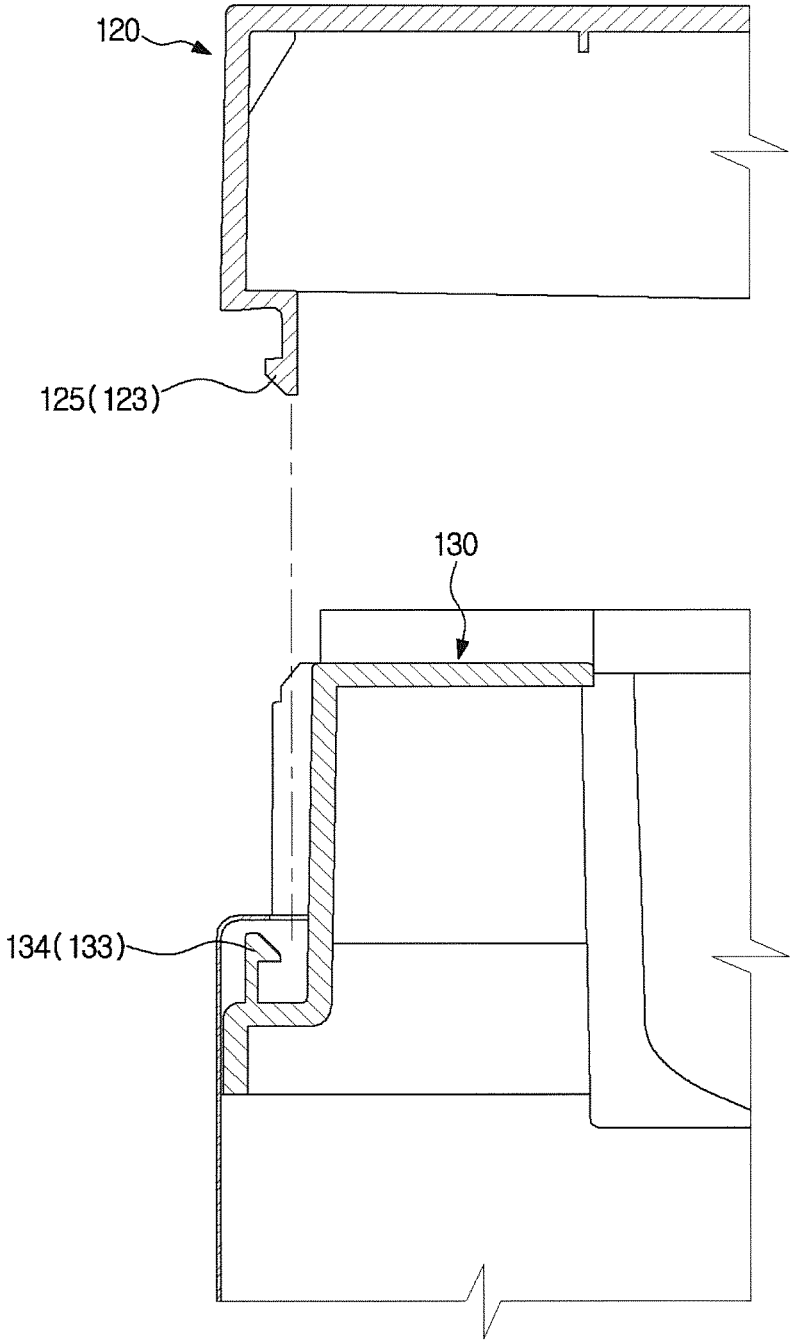
FIGS. 11 and 12 are views illustrating a state in which the first coupling hook of the door cap is coupled to the coupling protrusion of the door cap supporting part according to one embodiment of the present disclosure.
Figure 12:
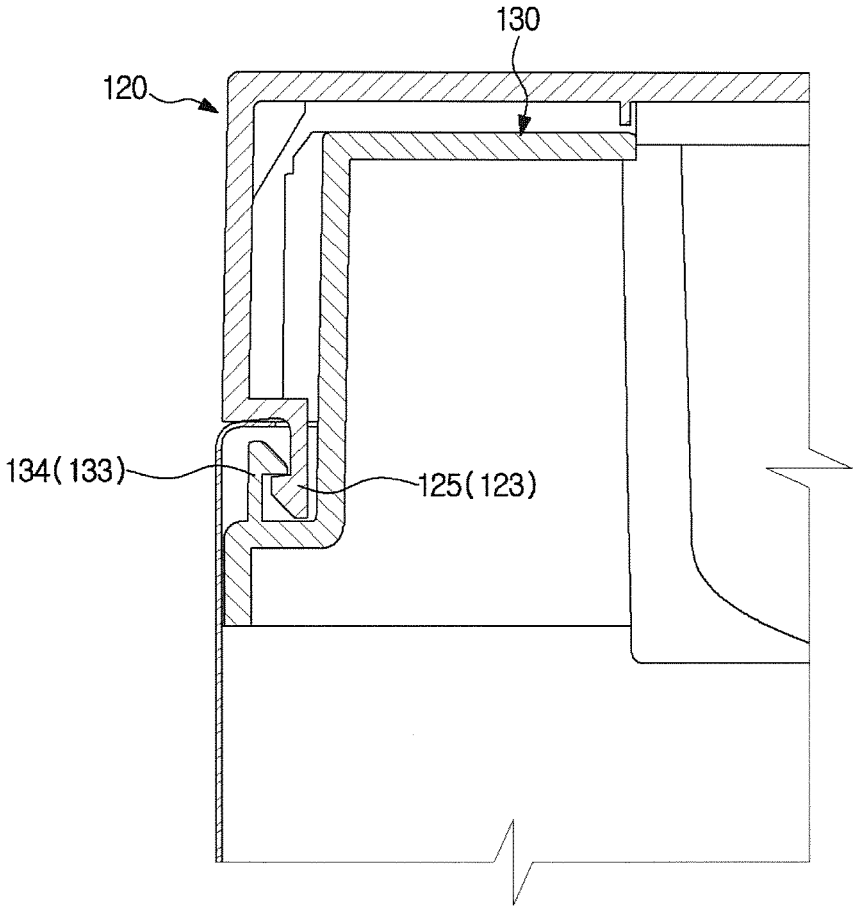

As illustrated in FIGS. 9 and 10, the second coupling hooks 127 of the door cap 120 are inserted into and coupled to the coupling holes 135 of the door cap supporting part 130. As illustrated in FIGS. 11 and 12, the first coupling hook 125 of the door cap 120 is coupled to the coupling protrusion 134 of the door cap supporting part 130.

Figure 13:
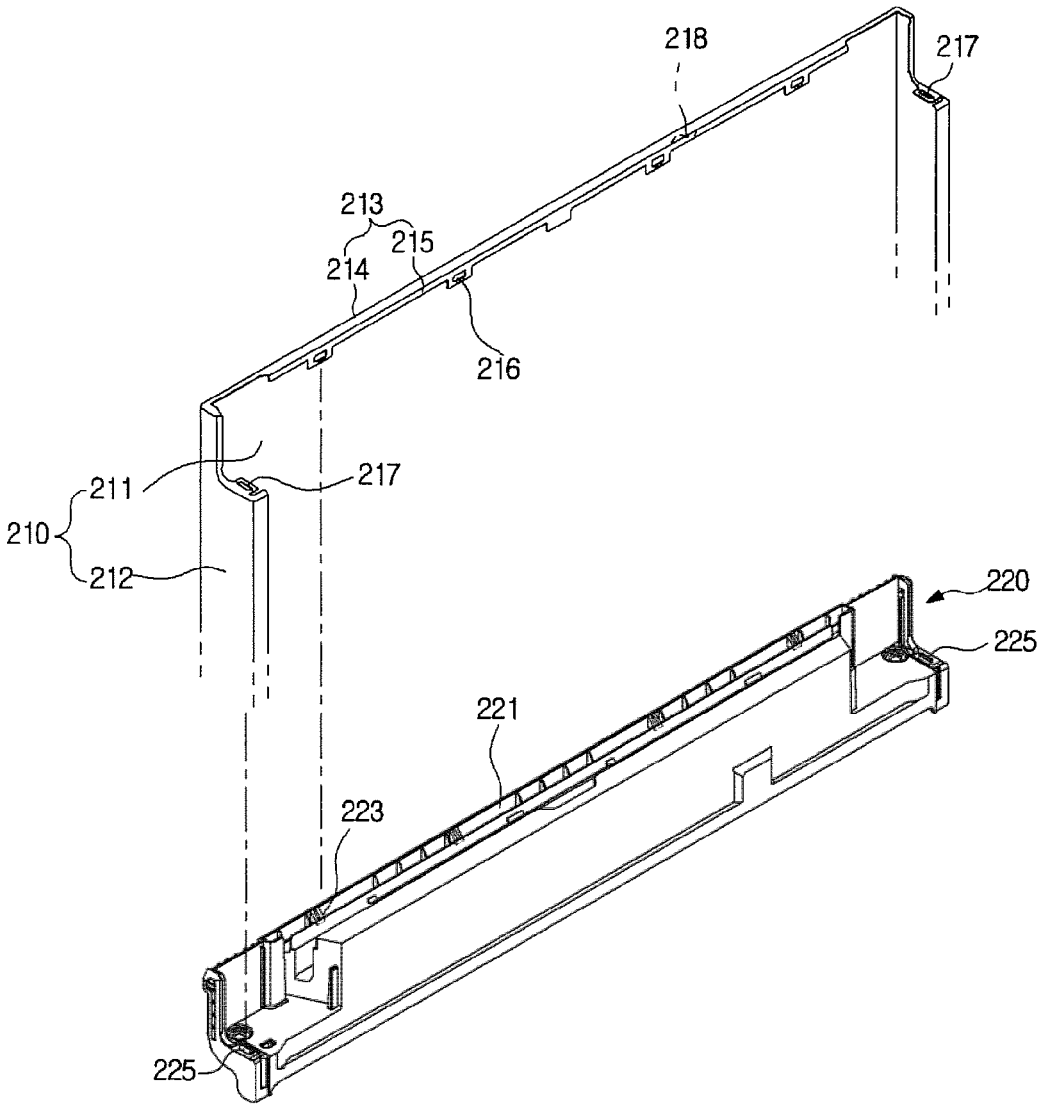
FIGS. 13 and 14 are views illustrating a state in which the door cap is coupled to a door plate of a refrigerator compartment door assembly according to one embodiment of the present disclosure.
Figure 14:
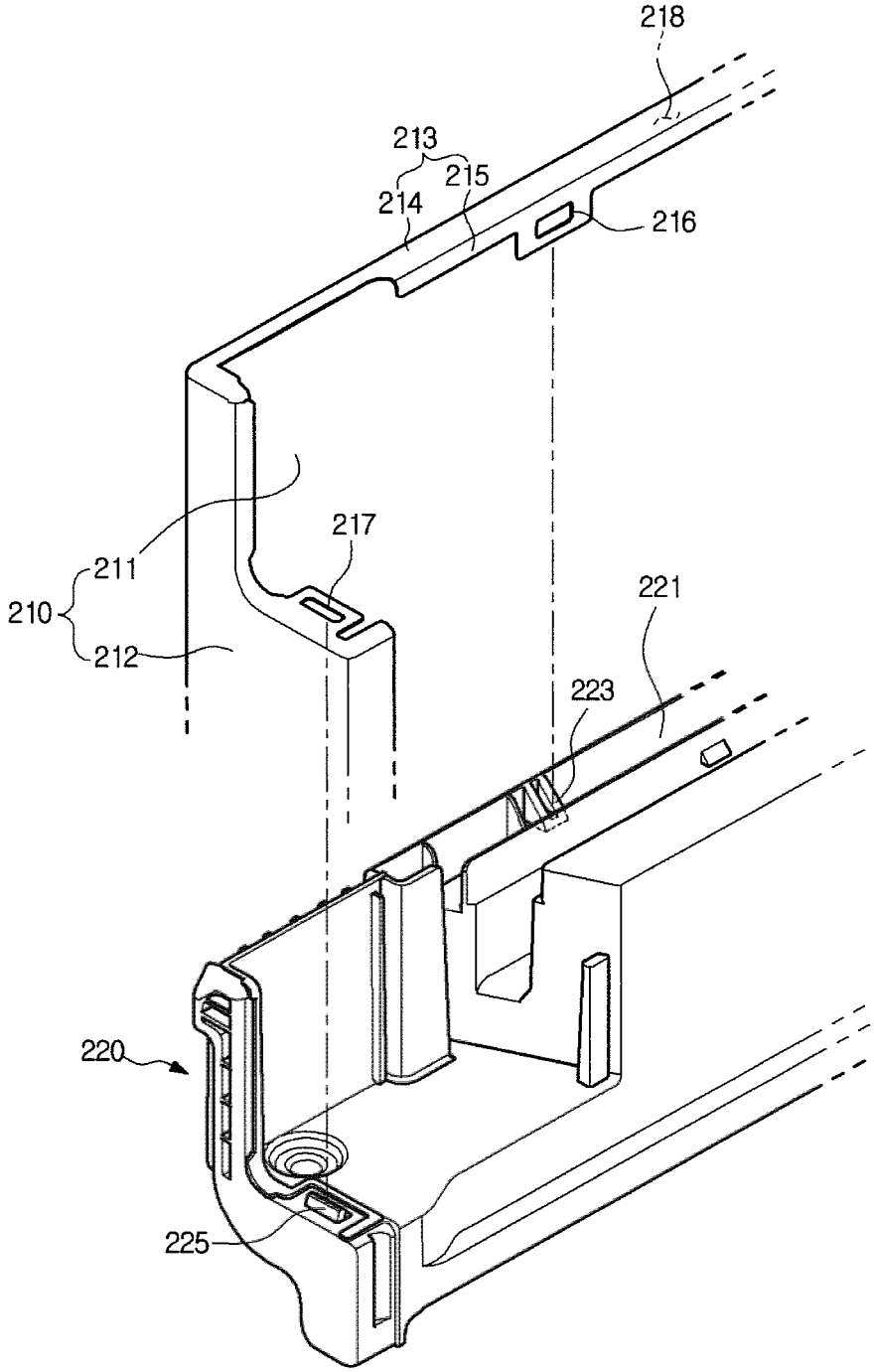

As illustrated in FIGS. 2, 13 and 14, the refrigerator compartment door assembly 200 which opens and closes the refrigerator compartment 21 includes a door plate 210 which forms a front surface and side surfaces of the refrigerator compartment door assembly 200 and a door cap 220 which covers an upper portion of the door plate 210.

The door plate 210 includes a front plate 211 which forms a front surface of the refrigerator compartment door assembly 200 and side plates 212 which are provided to be bent backward from both sides of the front plate 211 and form the side surfaces of the refrigerator compartment door assembly 200. A rear plate 219 (referring to FIG. 16) is coupled to a rear surface of the door plate 210 and forms a rear surface of the refrigerator compartment door assembly 200.

A bent portion 213 to which the door cap 220 is fixed is provided at an upper end of the front plate 211. The bent portion 213 includes a first bent portion 214 which is formed backward at the upper end of the front plate 211 to be bent vertically to the front plate 211 and a second bent portion 215 which is formed downward at an end of the first bent portion 214 to be bent vertically to the first bent portion 214.

Therefore, a fixing groove 218 which is opened downward is provided between the front plate 211 and the second bent portion 215, and the door cap 220 is inserted into the fixing groove 218 from a lower side of the fixing groove 218 toward an upper side thereof and fixed to the fixing groove 218.

A first coupling hole 216 and a second coupling hole 217 to which the door cap 220 is coupled are provided at the second bent portion 215 and the side plates 212, respectively.

The door cap 220 includes an inserting portion 221 which covers an upper portion of the door plate 210 and is inserted into the fixing groove 218 and a first coupling protrusion 223 and a second coupling protrusion 225 which are coupled to the door plate 210.

The first coupling protrusion 223 and the second coupling protrusion 225 of the door cap 220 are provided at positions corresponding to the first coupling hole 216 and the second coupling hole 217 of the door plate 210 when the inserting portion 221 is fixed to the fixing groove 218.

Therefore, when the inserting portion 221 of the door cap 220 is inserted into the fixing groove 218, the first coupling protrusion 223 is coupled to the first coupling hole 216, and the second coupling protrusion 225 is inserted into the second coupling hole 217.

Because the first coupling protrusion 223 and the first coupling hole 216 for coupling between the front plate 211 of the door plate 210 and the door cap 220 are located at a rear of the bent portion 213, a portion at which the first coupling protrusion 223 and the first coupling hole 216 are coupled to each other is not exposed to a front surface of the refrigerator compartment door assembly 200 when the door cap 220 is coupled to the door plate 210.

Since the portion at which the door plate 210 and the door cap 220 are coupled to each other is not exposed to the front surface of the refrigerator, the external appearance becomes simplified and may result in a good design, and also foreign substances may be prevented from entering through a gap of the portion at which the door plate 210 and the door cap 220 are coupled to each other.

Figure 15:
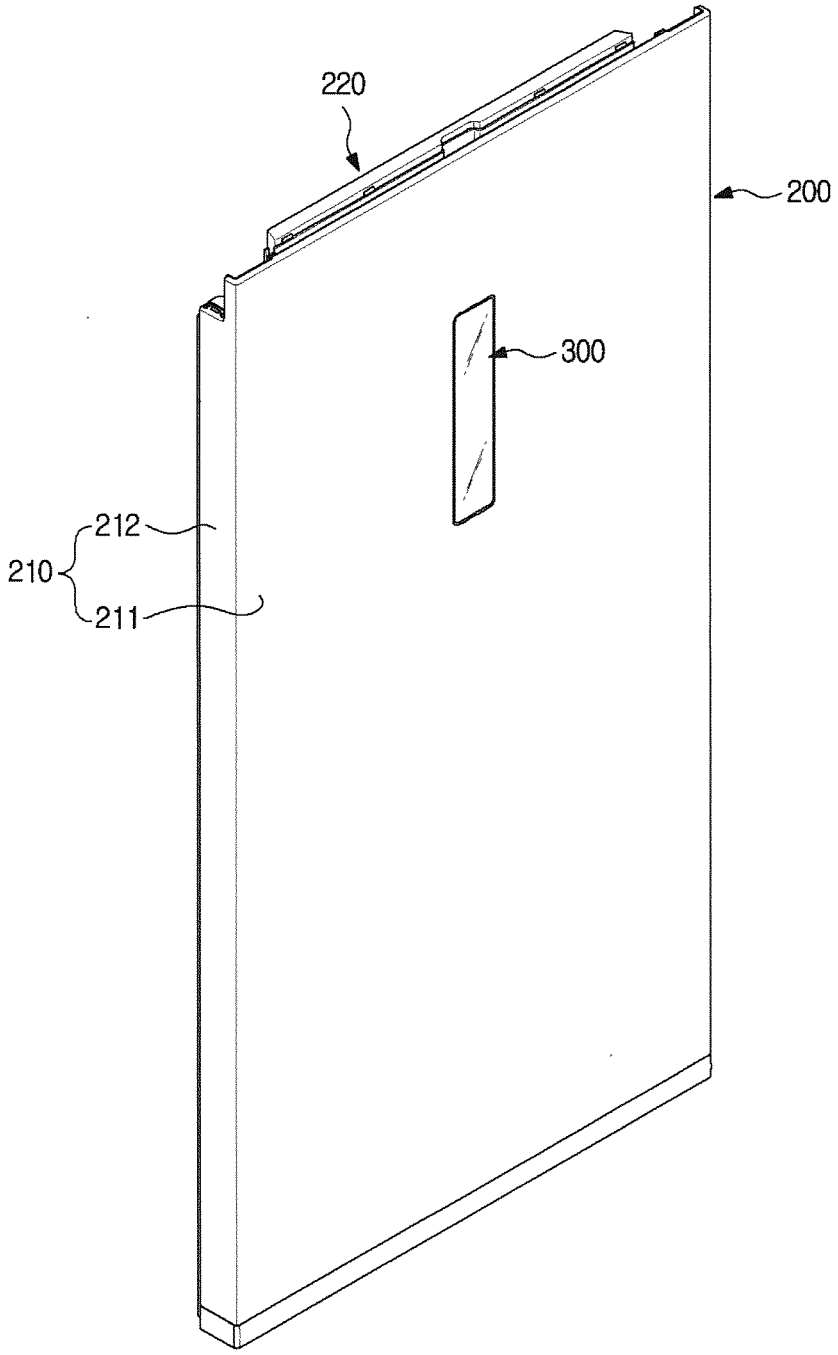
FIG. 15 is a view illustrating a state in which a display unit is provided at the refrigerator compartment door assembly according to one embodiment of the present disclosure.

As illustrated in FIGS. 2 and 15, a display unit 300 is provided at the refrigerator compartment door assembly 200.

Figure 16:
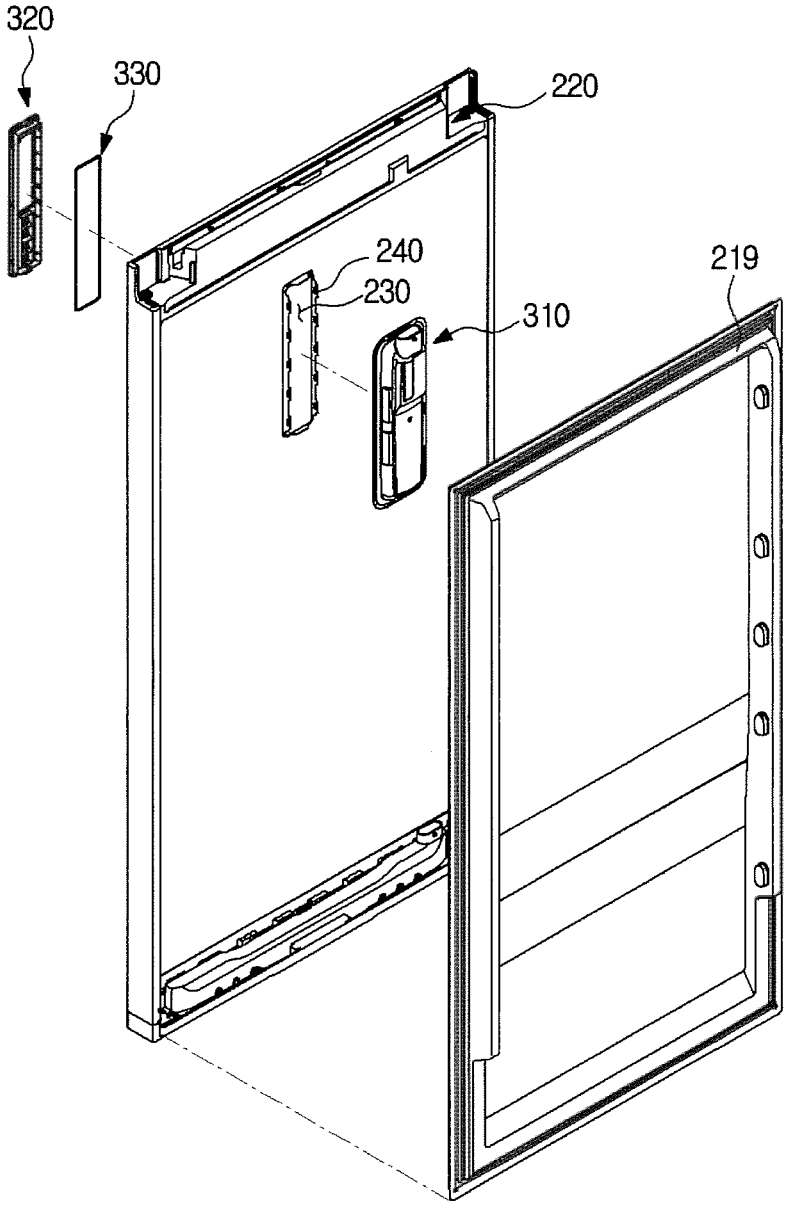
FIG. 16 is an exploded perspective view of the display unit and the refrigerator compartment door assembly according to one embodiment of the present disclosure.
Figure 17:
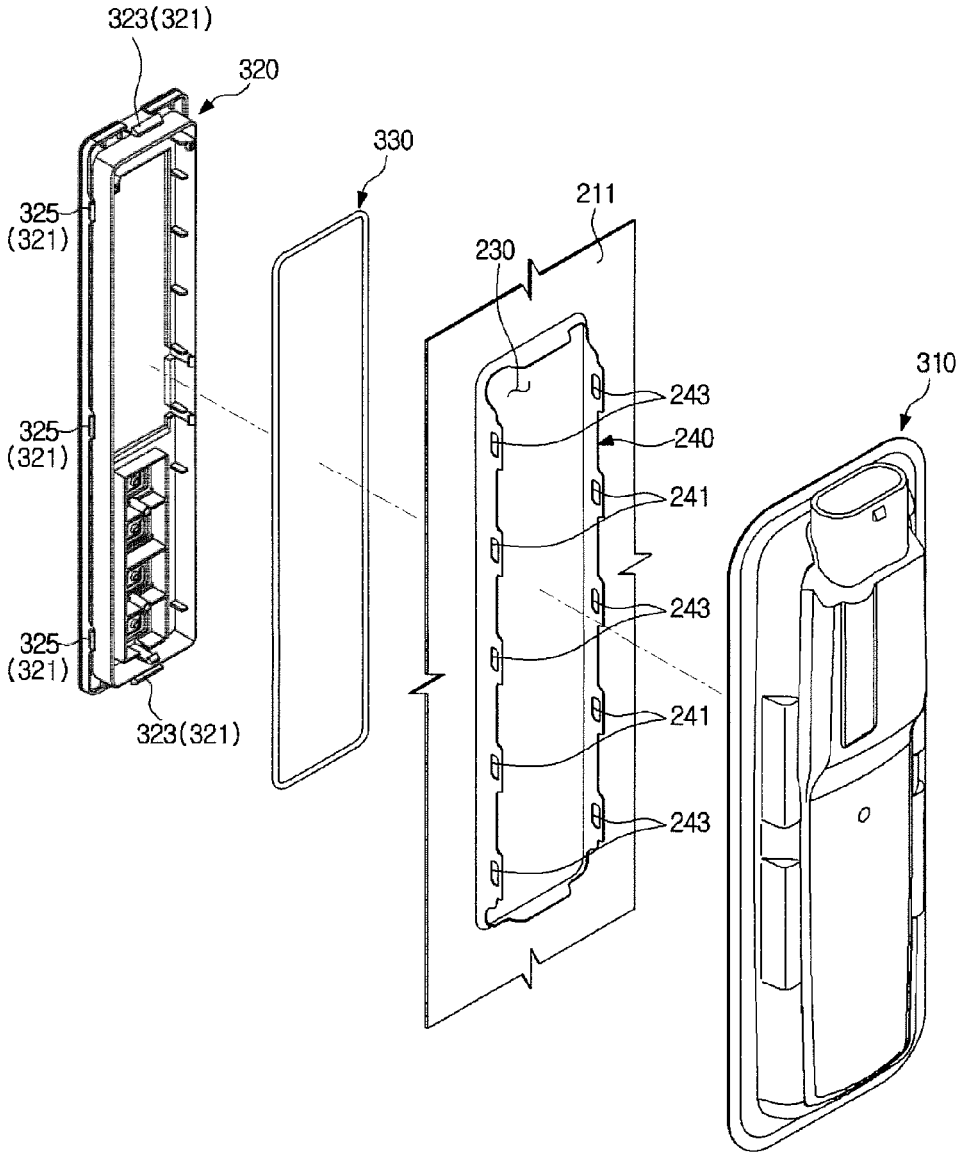
FIG. 17 is an exploded perspective view of the display unit according to one embodiment of the present disclosure.
Figure 18:
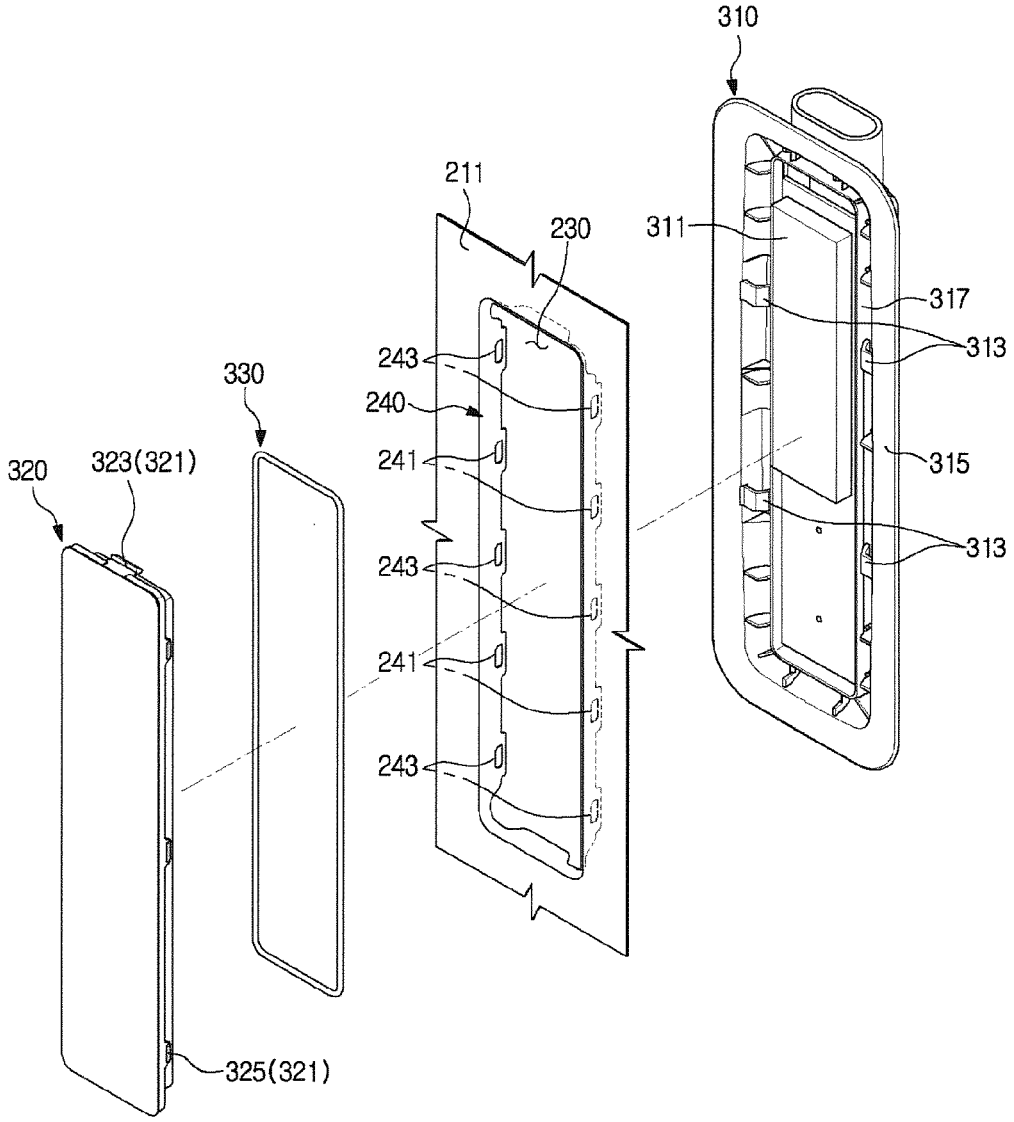
FIG. 18 is a view when
Figure 19:
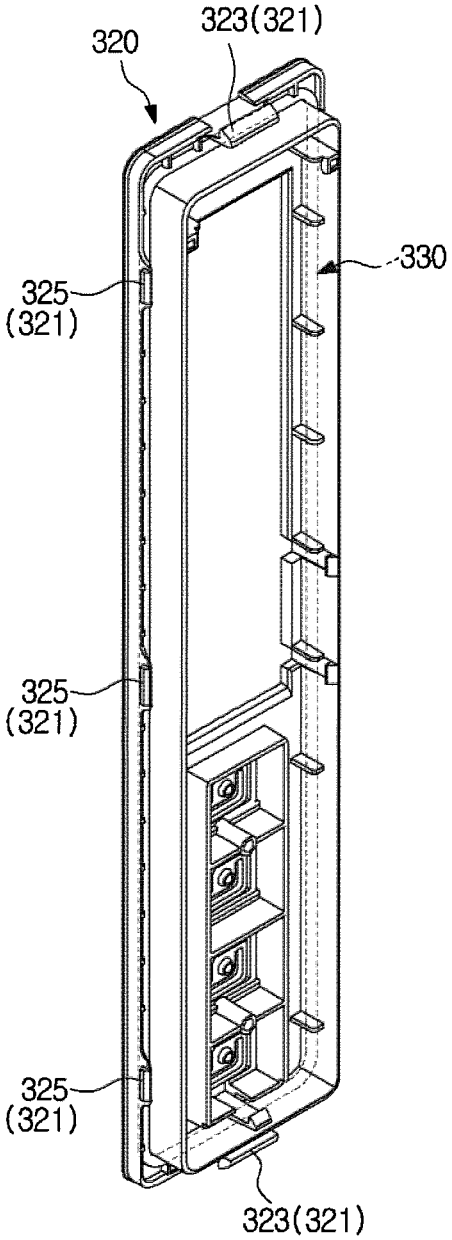
FIG. 19 is a view illustrating a state in which a displaying part is coupled to a coupling portion according to one embodiment of the present disclosure.
Figure 20:
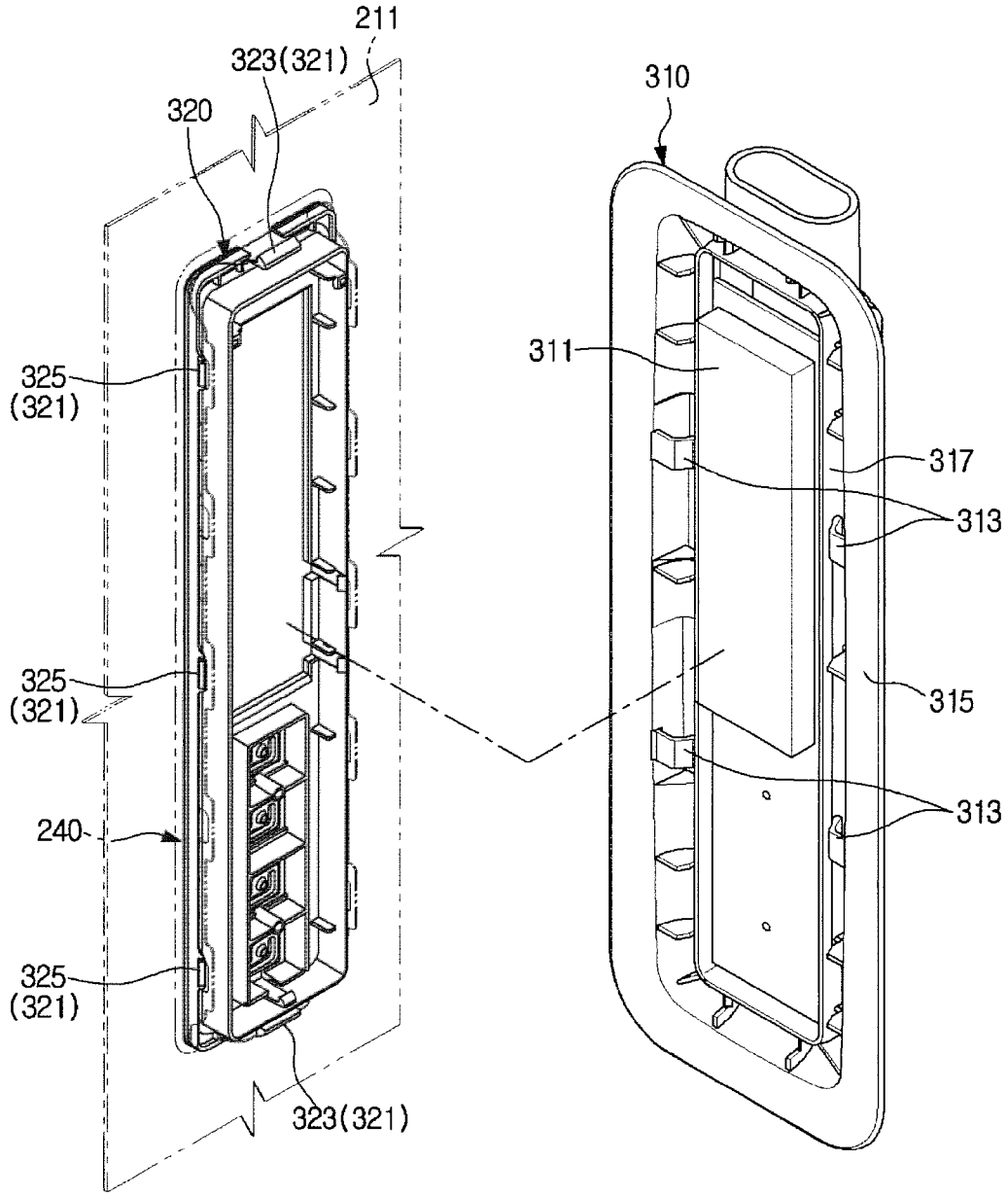
FIG. 20 is a view illustrating a state in which a display installation part is coupled to the coupling portion according to one embodiment of the present disclosure.
Figure 21:
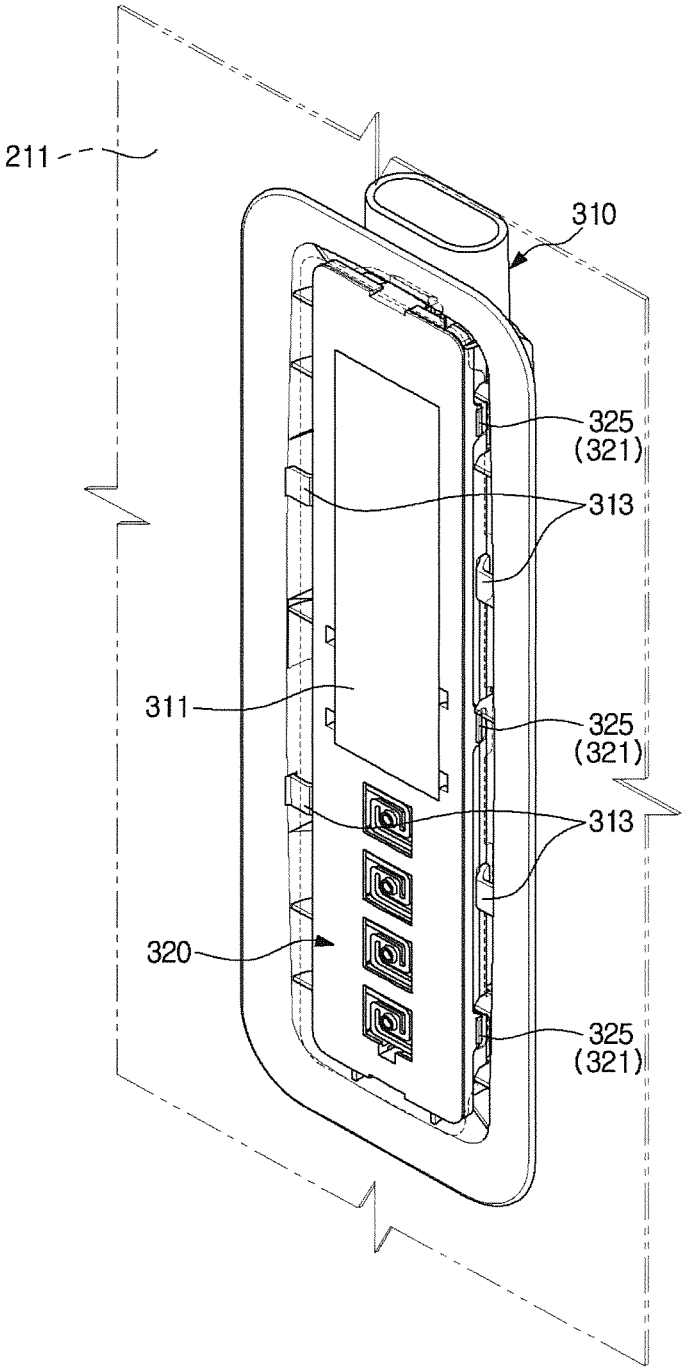
FIG. 21 is a view illustrating a state in which the display installation part and the displaying part are coupled to the coupling portion according to one embodiment of the present disclosure.

As illustrated in FIGS. 15 and 16, the refrigerator compartment door assembly 200 includes the door plate 210 which forms the front surface and the side surfaces of the refrigerator compartment door assembly 200, and the rear plate 219 which forms the rear surface of the refrigerator compartment door assembly 200. An insulation material U is filled between the door plate 210 and the rear plate 219 (Referring to FIGS. 22 and 23).

An opening 230 through which a front surface of the display unit 300 is exposed to an outside is provided at a front surface of the door plate 210.

A coupling portion 240 which is bent downward toward an inside of the door plate 210 and to which a display installation part 310 and a displaying part 320 which will be described below are coupled is provided at an edge of the opening 230.

The display unit 300 may display operation information of the refrigerator or may receive an operation command of the refrigerator.

As illustrated in FIGS. 17 to 23, the display unit 300 includes the display installation part 310 at which a display 311 is installed, the displaying part 320 which is disposed at a front surface of the display installation part 310 to indicate the operation information displayed on the display 311 to an outside, and a sealing member 330 which seals between the display installation part 310 and the displaying part 320 to prevent moisture from penetrating into the display unit 300.

The display installation part 310 is provided inside the refrigerator door assembly 200 to correspond to the opening 230 provided at the front surface of the door plate 210.

The display installation part 310 includes a plurality of coupling ribs 313 which are coupled to the coupling portion 240 provided at the edge of the opening 230 to be bent, a close contact portion 315 which is in close contact with the rear surface of the door plate 210 to prevent the insulation material U from penetrating into the display installation part 310, and a protruding rib 317 which is provided to correspond to a seating groove 327 of the displaying part 320 which will be described below.

The plurality of coupling ribs 313 are provided at both sides of the display installation part 310, and a plurality of first coupling holes 241 to which the plurality of coupling ribs 313 are coupled are provided at both sides of the coupling portion 240.

The close contact portion 315 is in close contact with a rear surface of the front plate 211 of the door plate 210 when the display installation part 310 is coupled to the coupling portion 240 and prevents the insulation material U filled in the refrigerator door assembly 200 from penetrating into the display installation part 310.

The displaying part 320 is disposed at the front surface of the display installation part 310 and exposed to the outside through the opening 230 provided at the front surface of the door plate 210.

The front surface of the displaying part 320 exposed to the outside through the opening 230 may be formed of a transparent material which enables the operation information displayed on the display 311 to be recognized from the outside.

The displaying part 320 includes a plurality of coupling hooks 321 which are coupled to the coupling portion 240, and the seating groove 327 in which the sealing member 330 is seated.

The coupling hooks 321 includes a first coupling hook 323 which is provided at each of upper and lower portions of the displaying part 320, and a plurality of second coupling hook 325 which are provided at both side surfaces of the displaying part 320.

The first coupling hook 323 is coupled to the upper and lower portions of the coupling portion 240, and a plurality of second coupling holes 243 to which the second coupling hooks 325 are coupled are provided at both side surfaces of the coupling portion 240.

Figure 22:
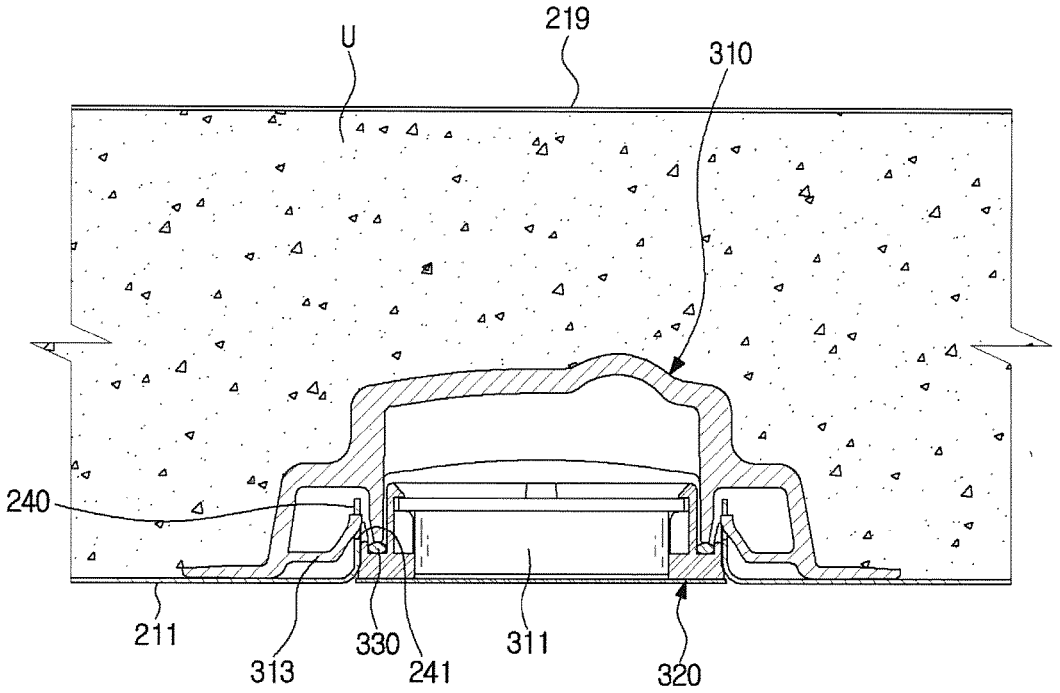
FIG. 22 is a cross-sectional view of a portion at which a coupling rib of the display installation part is coupled into a first coupling hole of the coupling portion according to one embodiment of the present disclosure.
Figure 23:
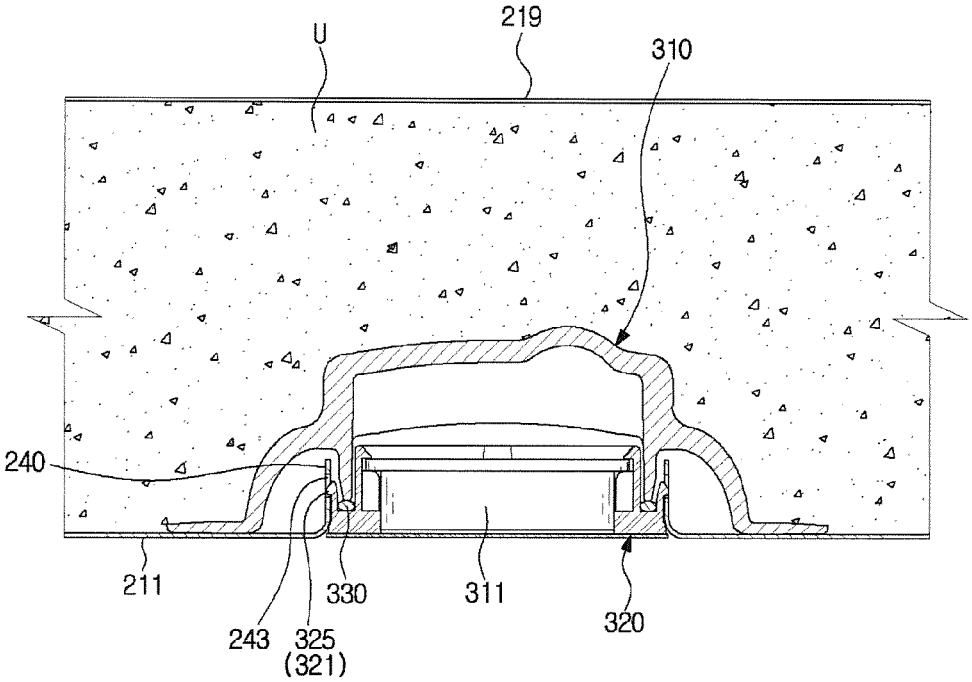
FIG. 23 is a cross-sectional view of a portion at which the second coupling hook of the displaying part is coupled into a second coupling hole of the coupling portion according to one embodiment of the present disclosure.

The plurality of first coupling holes 241 to which the coupling ribs 313 of the display installation part 310 are coupled and the plurality of second coupling holes 243 to which the second coupling hooks 325 of the displaying part 320 are coupled are provided at both side surfaces of the coupling portion 240. The second coupling holes 243 are located between the first coupling holes 241, and the first coupling holes 241 are located between the second coupling holes 243. (FIG. 22 is a cross-sectional view of a portion at which the coupling rib 313 of the display installation part 310 is coupled to the first coupling hole 241, and FIG. 23 is a cross-sectional view of a portion at which the second coupling hook 325 of the displaying part 320 is coupled to the second coupling hole 243)

When the display installation part 310 and the displaying part 320 are coupled to the coupling portion 240 while the sealing member 330 is seated in the seating groove 327 of the displaying part 320, the protruding rib 317 of the display installation part 310 is provided at a position corresponding to the seating groove 327, and thus the sealing member 330 is pressed while the protruding rib 317 is inserted into the seating groove 327.

Since the sealing member 330 is pressed by the protruding rib 317 and the seating groove 327, the display installation part 310 and displaying part 320 are in close contact with each other by the sealing member 330, and thus moisture is prevented from penetrating into the display unit 300.

Since the refrigerator compartment 21 is maintained at a temperature lower than that of the outside, a temperature of the front surface of the refrigerator compartment door assembly 200 which is in contact with the outside of the refrigerator compartment 21 becomes lower than that of the outside through a heat exchange.

When a temperature of air containing the moisture is lowered, relative humidity is increased and reaches 100%, and the moisture starts to condense. At this point, the temperature is referred to as the dew-point temperature.

A portion of the front surface of the refrigerator compartment door assembly 200 at which the display unit 300 is provided has the insulation material U which is thinner than other portions, and thus when the temperature of the front surface of the refrigerator compartment door assembly 200 is lowered and reaches the dew-point temperature, moisture is condensed and forms the dews on the front surface of the refrigerator compartment door assembly 200.

Since the displaying part 320 is exposed to the front surface of the refrigerator compartment door assembly 200, the dew would penetrate into the display unit 300 when the dew is formed on the front surface of the refrigerator compartment door assembly 200, however, since the sealing member 330 seals between the display installation part 310 and the displaying part 320, the moisture is prevented from penetrating into the display unit 300, and thus an electrical damage or a malfunction of the display 311 due to penetration of the moisture into the display unit 300 may be prevented.

Also, since the penetration of the moisture into the display unit 300 is prevented, the overall humidity of the display unit 300 is lowered.

Since the dew-point temperature of dry air is lower than that of high-humidity air, the humidity of the displaying part 320 is lowered when the overall humidity of the display unit 300 is lowered, and thus the dew formation occurring on the displaying part 320 may be minimized.

As illustrated in FIG. 1, the gasket 400 which maintains an airtightness between the main body 10 and the door assemblies 100 and 200 when the door assemblies 100 and 200 are closed is coupled to a rear surface of each of the door assemblies 100 and 200.

For convenience, a structure in which the gasket 400 is coupled to the rear surface of each of the door assemblies 100 and 200 will be described using a structure in which the gasket 400 is coupled to the rear surface of the freezer compartment door assembly 100.

Figure 24:
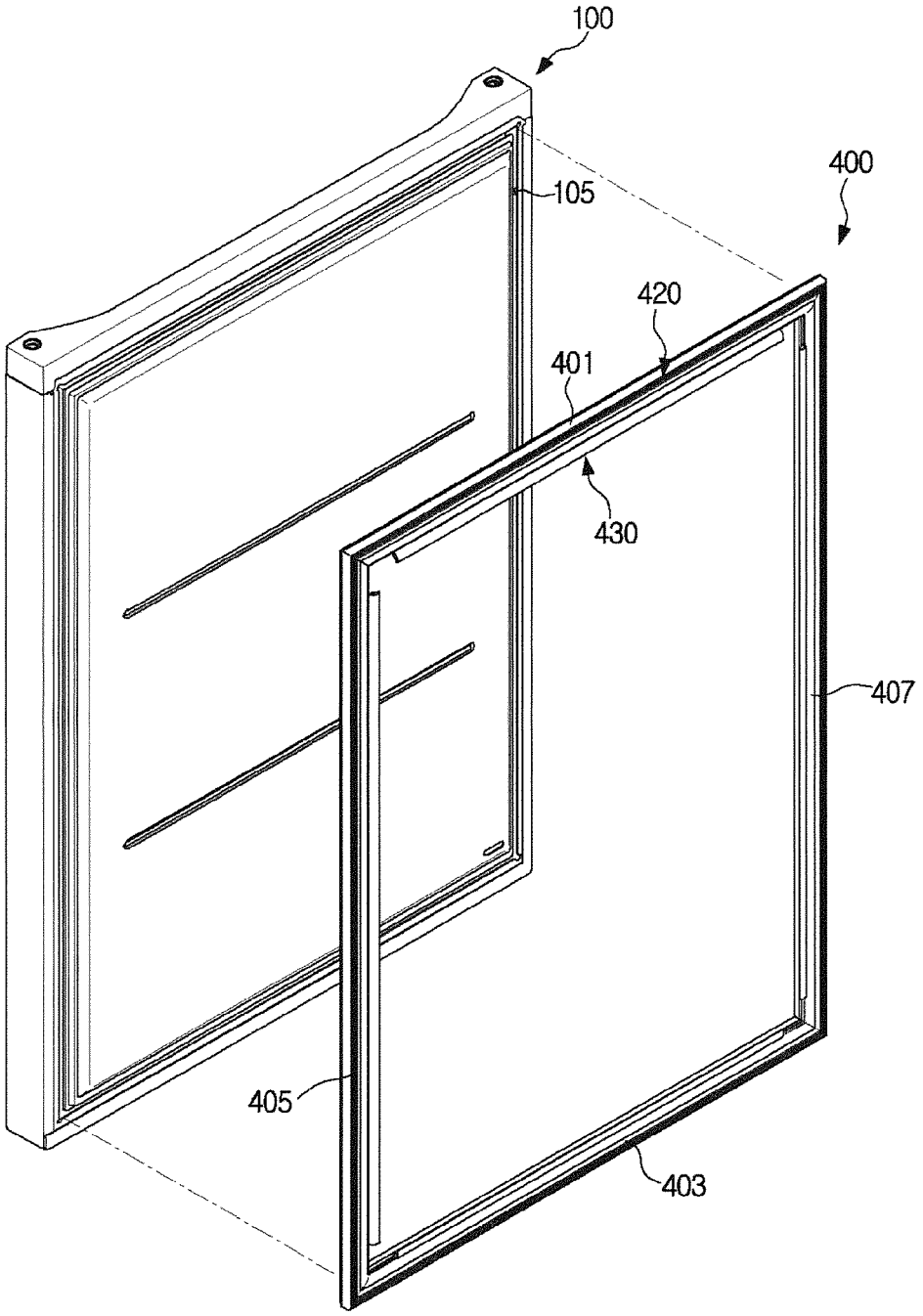
FIG. 24 is a view illustrating a state in which a gasket is being coupled to a rear surface of the freezer compartment door assembly according to one embodiment of the present disclosure.
Figure 25:
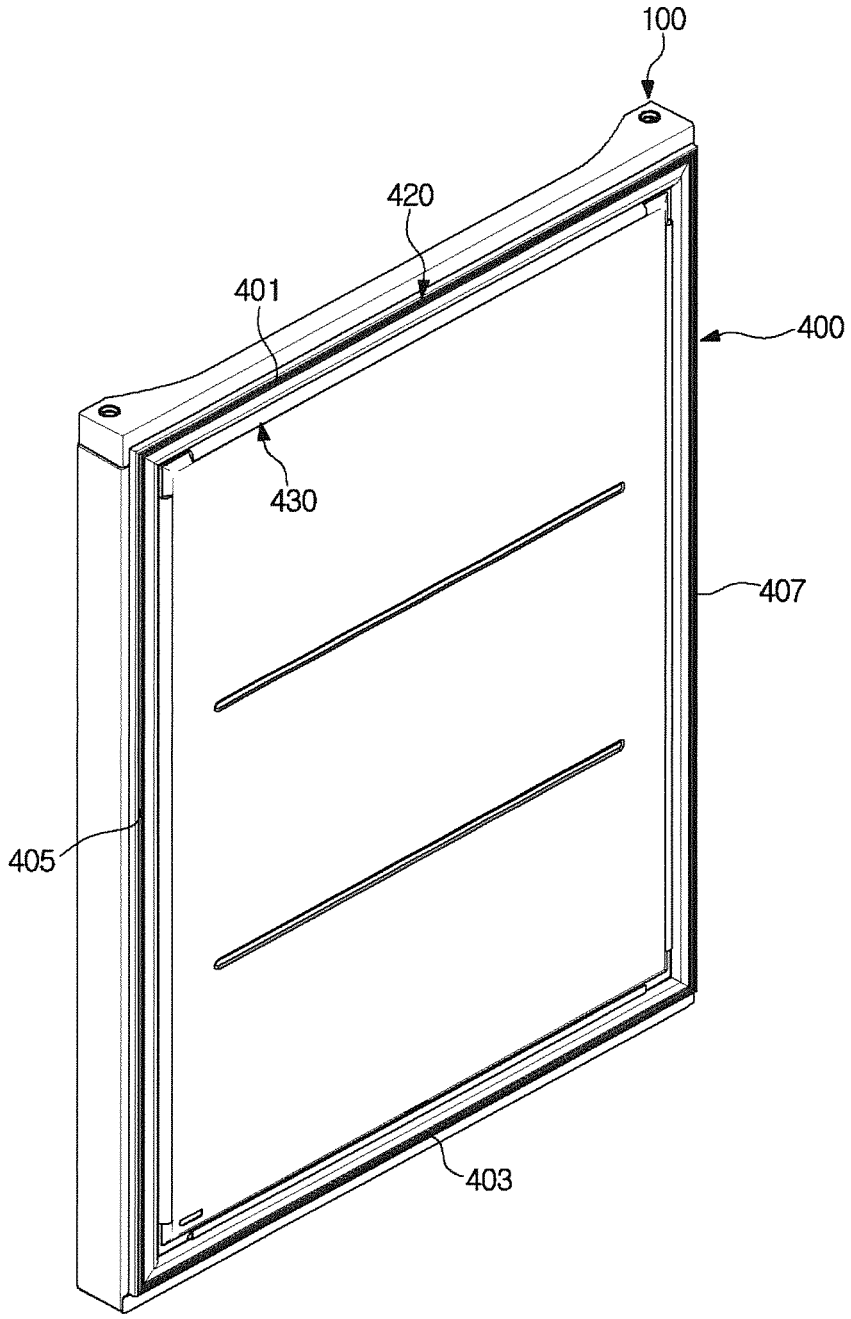
FIG. 25 is a view illustrating a state in which a gasket is coupled to the rear surface of the freezer compartment door assembly according to one embodiment of the present disclosure.
Figure 26:
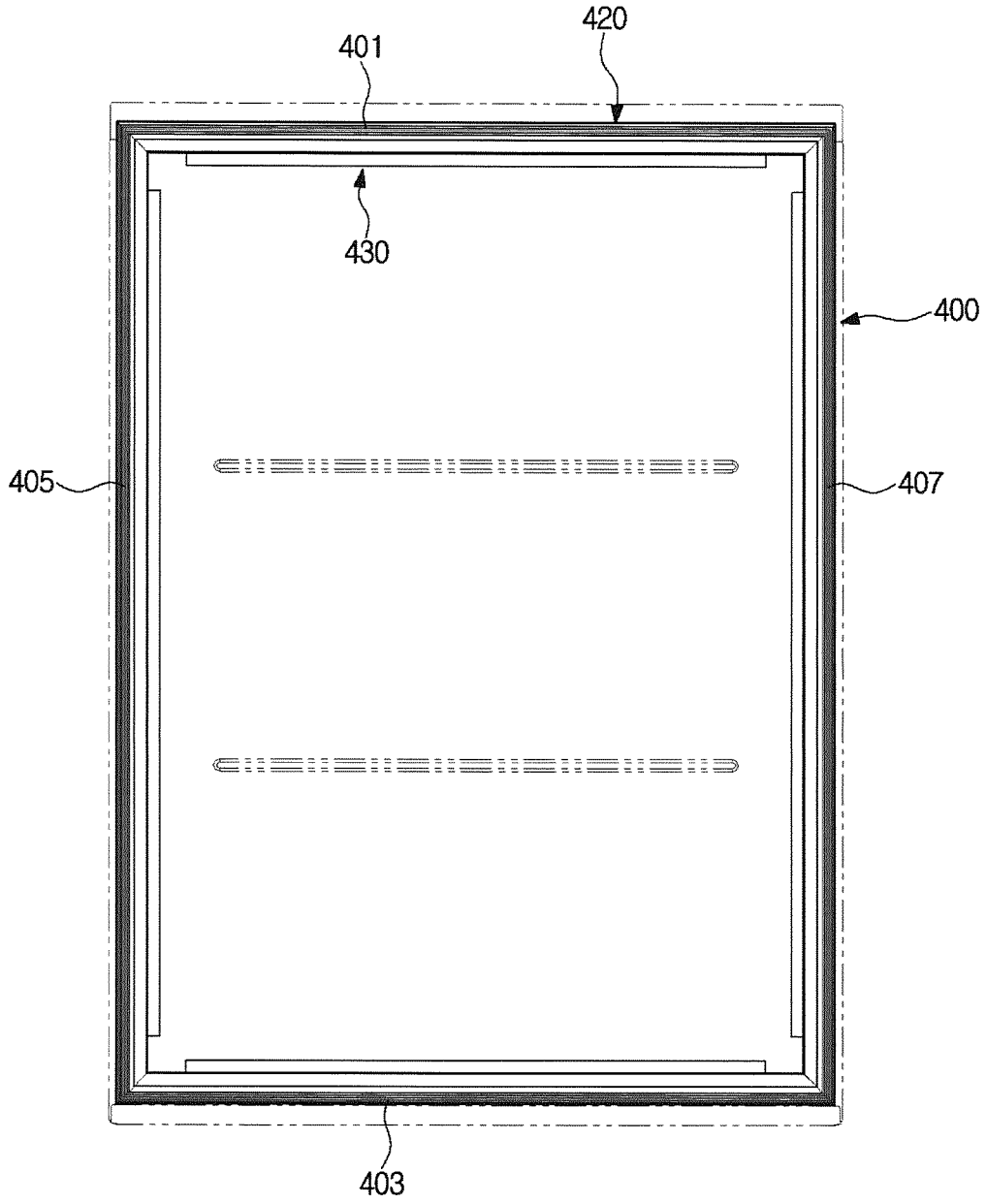
FIG. 26 is a plane view of FIG. 25 according to one embodiment of the present disclosure.

As illustrated in FIGS. 24 to 26, the gasket 400 is integrally injection-molded, and coupled to the rear surface of the freezer compartment door assembly 100. When the door assembly 100 is closed, the gasket 400 maintains the airtightness between the main body 10 and the freezer compartment door assembly 100, and thus prevents the cool air in the freezer compartment 23 from leaking to an outside.

The gasket 400 includes an upper gasket 401 which is coupled to an upper portion of the rear surface of the freezer compartment door assembly 100, a lower gasket 403 which is coupled to a lower portion of the rear surface of the freezer compartment door assembly 100, a left gasket 405 which is coupled to a left side of the rear surface of the freezer compartment door assembly 100, and a right gasket 407 which is coupled to a right side of the rear surface of the freezer compartment door assembly 100.

Figure 27:
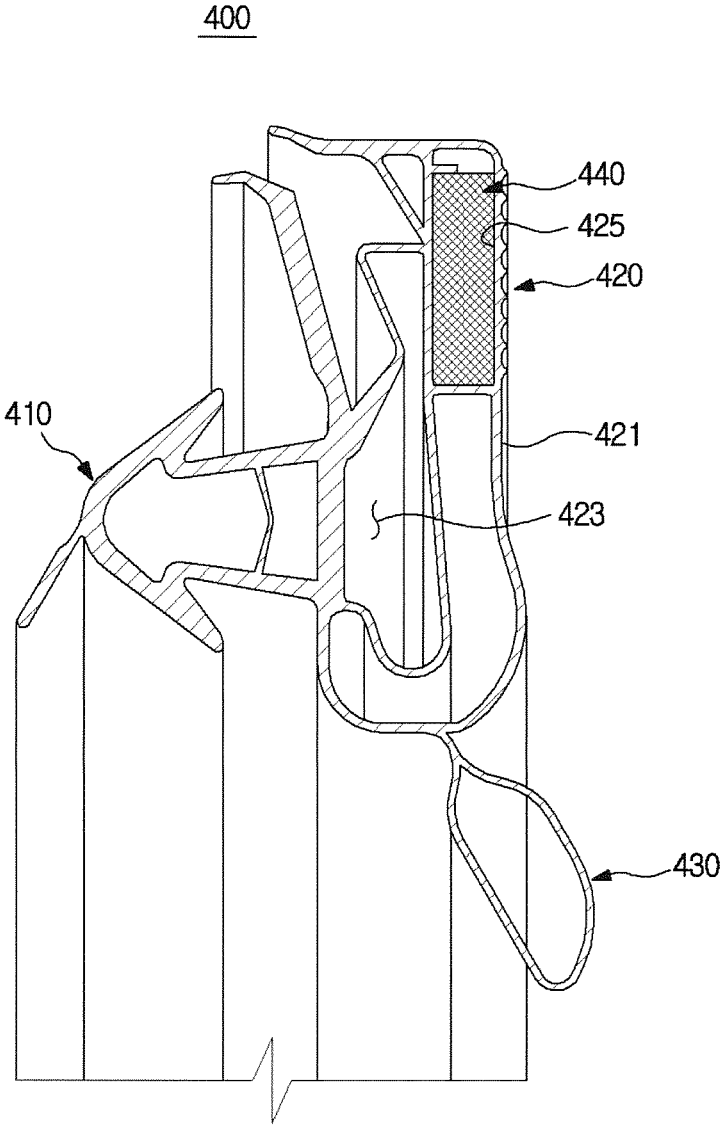
FIG. 27 is a view of the gasket according to one embodiment of the present disclosure.

As illustrated in FIG. 27, each of the gaskets 400 includes a coupling portion 410 which is coupled to the rear surface of the freezer compartment door assembly 100, a close contact portion 420 which is in close contact with the main body 10 when the freezer compartment door assembly 100 is closed and maintains the airtightness between the main body 10 and the freezer compartment door assembly 100, and a cool air leakage preventing portion 430 which extends from one side of the close contact portion 420 toward the freezer compartment 23 and prevents the cool air from leaking through a gap between the main body 10 and the freezer compartment door assembly 100.

As illustrated in FIG. 24, a coupling groove 105 to which the gasket 400 is coupled is provided at the rear surface of the freezer compartment door assembly 100, and the coupling portion 410 of the gasket 400 is coupled to the coupling groove 105.

The close contact portion 420 includes a contact portion 421 which is in contact with the main body 10 when the freezer compartment door assembly 100 is closed, a shock absorbing portion 423 which absorbs a shock generated between the main body 10 and the freezer compartment door assembly 100 when the freezer compartment door assembly 100 is closed, and a magnet accommodation portion 425 which accommodates a magnet 440 so that the freezer compartment door assembly 100 is in close contact with the main body 10.

The cool air leakage preventing portion 430 is provided to have a length shorter than that of the close contact portion 420, and prevents the cool air in the freezer compartment 34 from leaking through the gap between the main body 10 and the freezer compartment door assembly 100.

Figure 28:
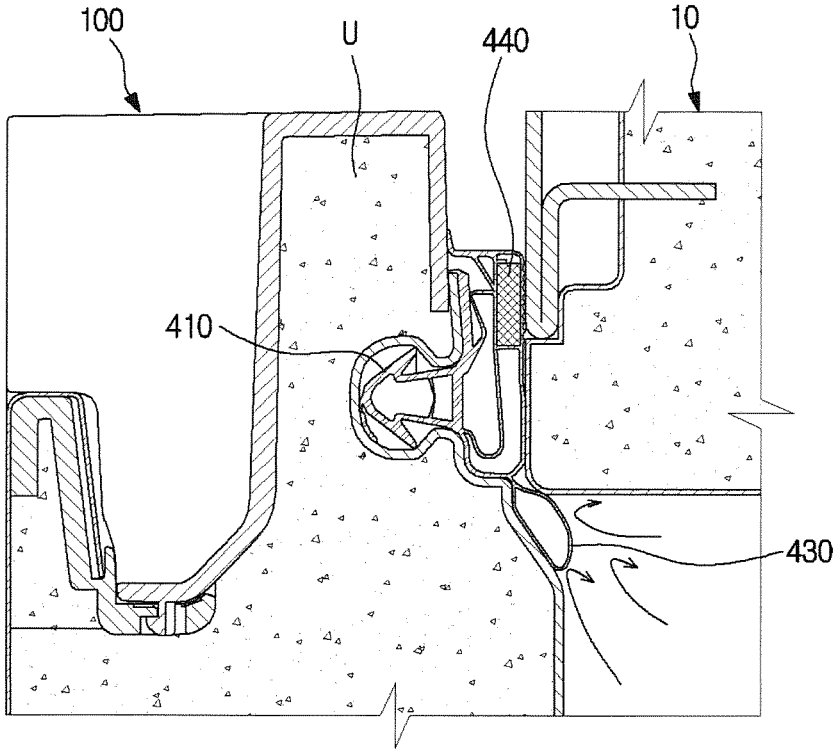
FIG. 28 is a view illustrating a state in which cooling air is prevented by a cooling air leakage preventing part of the gasket from leaking through a gap between a main body and the freezer compartment door assembly according to one embodiment of the present disclosure.

As illustrated in FIG. 28, the close contact portion 420 prevents the cool air in the freezer compartment 34 from leaking through the gap between the main body 10 and the freezer compartment door assembly 100. However, since the cool air leakage preventing portion 430 which extends from the close contact portion 420 doubly seals between the main body 10 and the freezer compartment door assembly 100, the leakage of the cool air in the freezer compartment 34 through the gap between the main body 10 and the freezer compartment door assembly 100 may be minimized.

A method for manufacturing the gasket will be described with reference to FIGS. 29 to 34.

Figure 29:
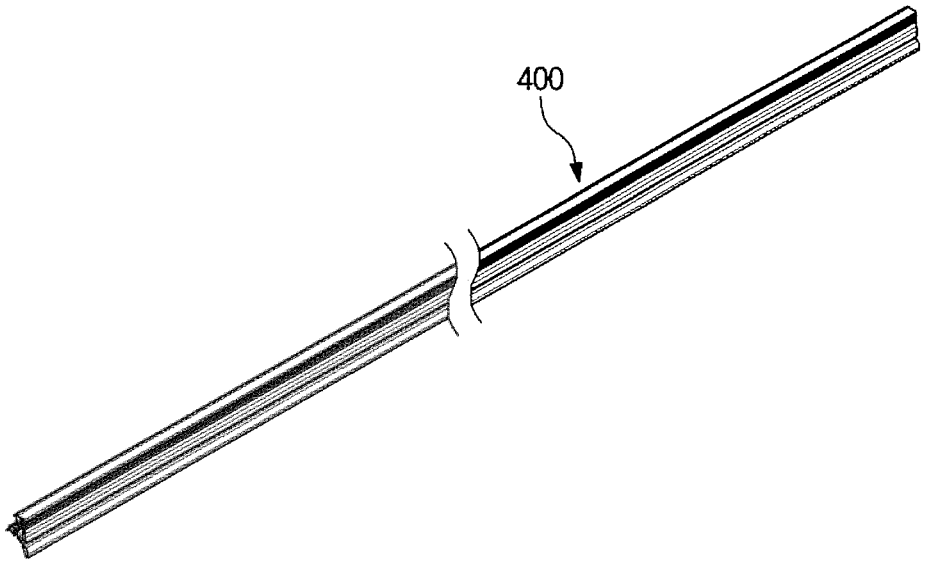
FIG. 29 illustrates a view of the gasket which is integrally extruded according to one embodiment of the present disclosure.

As illustrated in FIG. 29, the gasket 400 is integrally formed by an extrusion molding to make up the coupling portion 410, the close contact portion 420 and the cool air leakage preventing portion 430.

Figure 30:
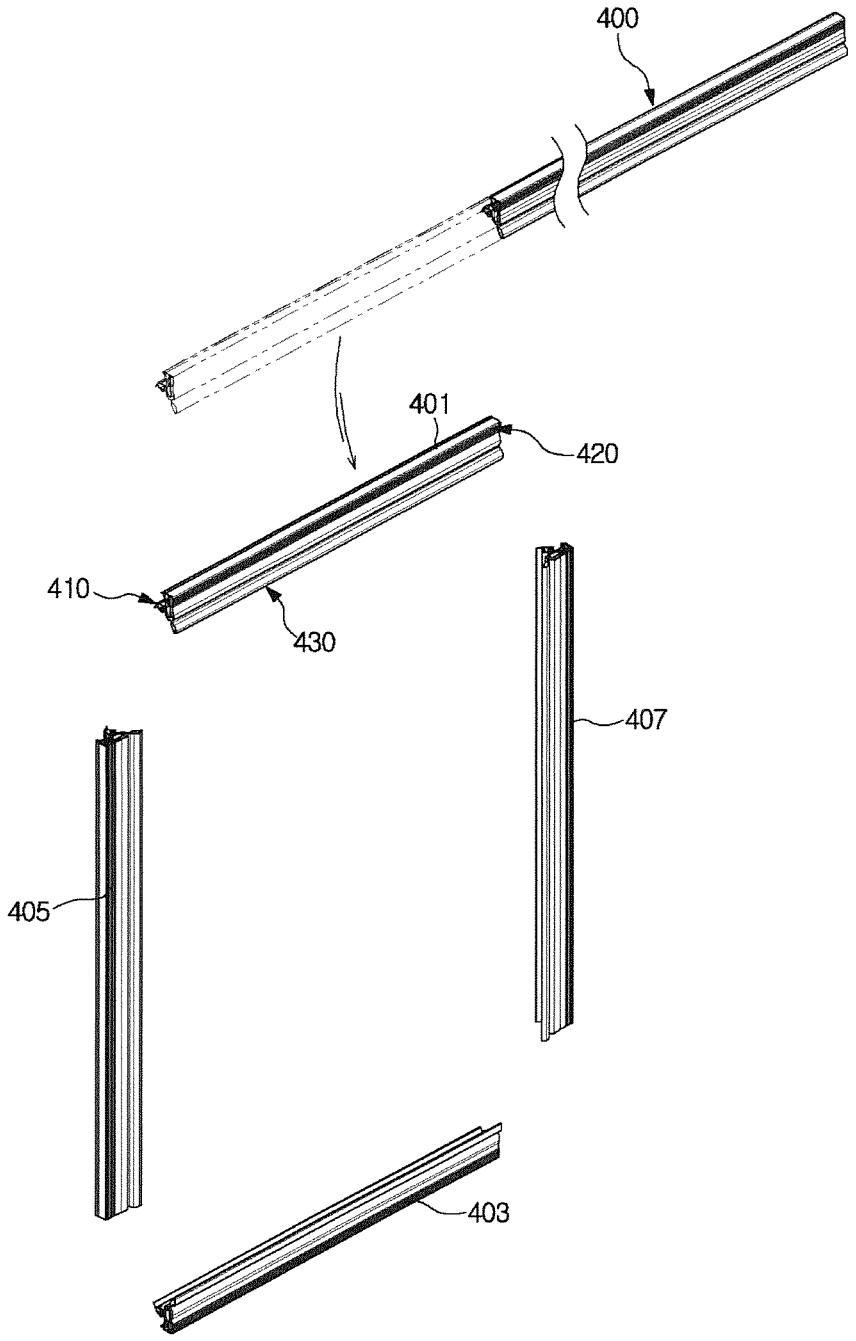
FIG. 30 illustrates a view of the gasket of FIG. 29 which is cut to have a length corresponding to each of upper and lower edges and left and right edges of the rear surface of the freezer compartment door assembly according to one embodiment of the present disclosure.

As illustrated in FIG. 30, the integrally extruded gasket 400 is cut to a length corresponding to each length of upper and lower edges and left and right edges of the rear surface of the freezer compartment door assembly 100.

Figure 31:
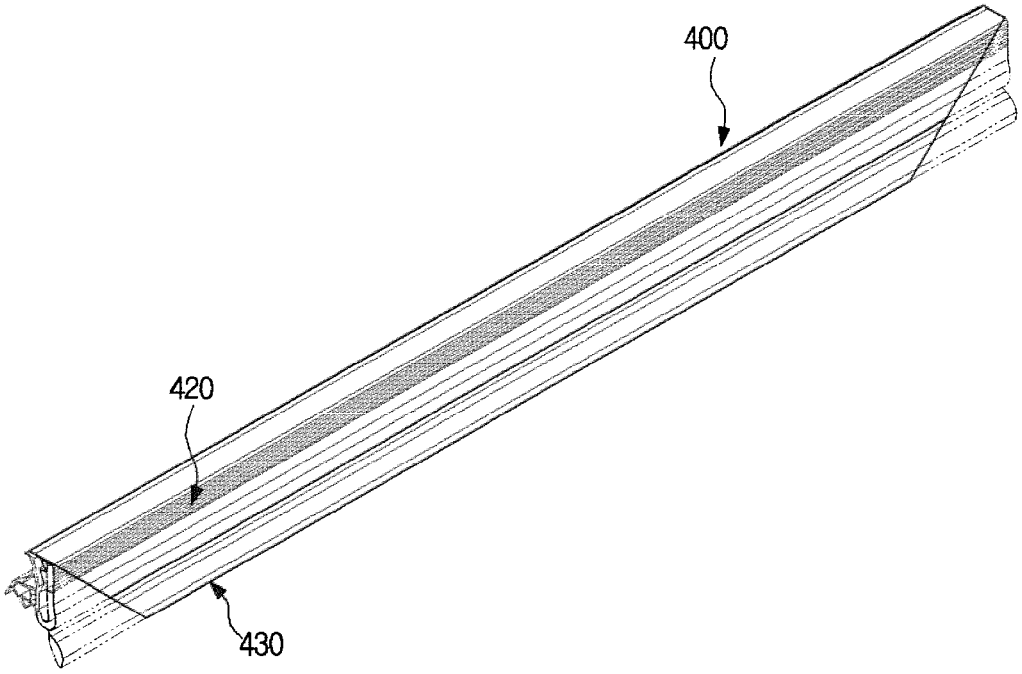
FIG. 31 illustrates a view of the gasket of FIG. 30 of which both ends are cut at an angle of 45 degrees according to one embodiment of the present disclosure.

When the gasket 400 is cut to the length corresponding to each length of upper and lower edges and left and right edges of the rear surface of the freezer compartment door assembly 100, both ends of each of the cut gaskets 400 are cut at an angle of 45 degrees to be bonded in a quadrangular shape corresponding to the edges of the rear surface of the freezer compartment door assembly 100, as illustrated in FIG. 31.

Figure 32:
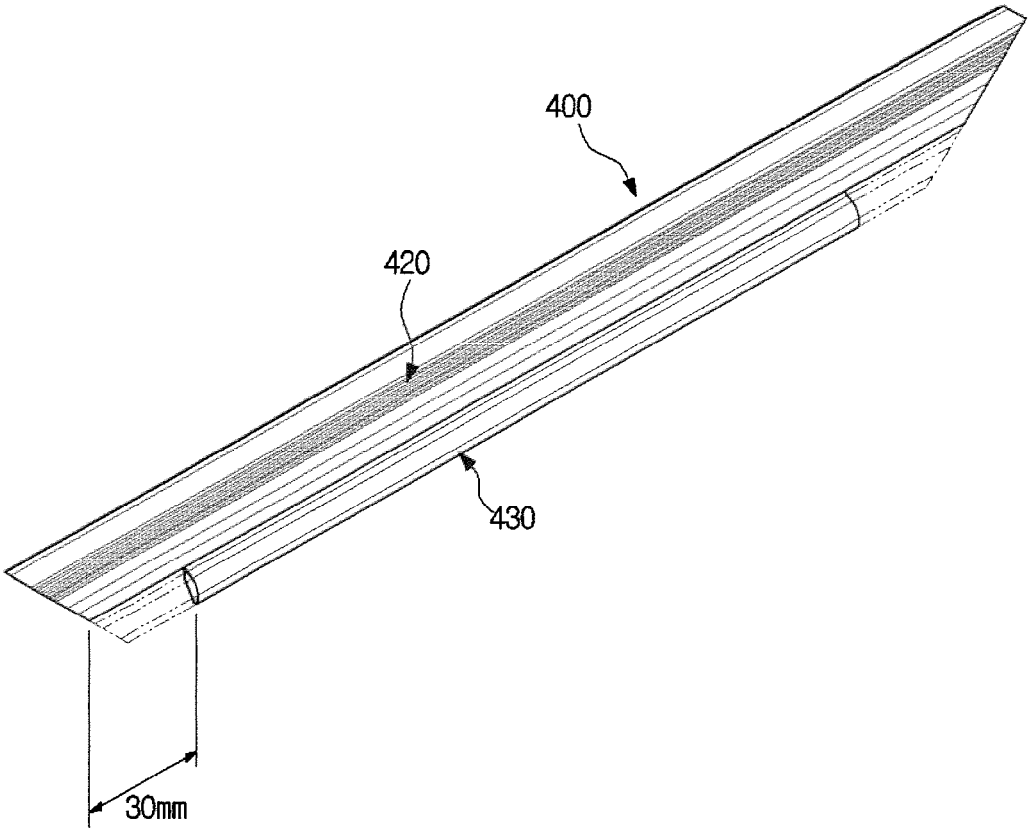
FIG. 32 illustrates a view of a cooling air leakage preventing part of FIG. 31 of which both ends are partially cut according to one embodiment of the present disclosure.

When both ends of each of the gaskets 400 are cut at the angle of 45 degrees, a part of both ends of the cool air leakage preventing portion 430 is cut so that the cool air leakage preventing portion 430 has a length shorter than the close contact portion 420, as illustrated in FIG. 32.

At this point, a cut length of the cool air leakage preventing portion 430 may be about 30 mm.

Each of the gaskets 400 of which both ends are cut at the angle of 45 degrees is bonded by thermal bonding to result in the quadrangular shape corresponding to the edges of the rear surface of the freezer compartment door assembly 100. For bonding each of the gaskets 400 by the thermal bonding, it is not easy to bond cross sections of the gasket 400 including all of the coupling portion 410, the close contact portion 420 and the cool air leakage preventing portion 430. Therefore, when a part of both ends of the cool air leakage preventing portion 430 is cut, and each gasket 400 is bonded by the thermal bonding, only the coupling portion 410 and the close contact portion 420 are provided to be bonded by the thermal bonding.

Figure 33:
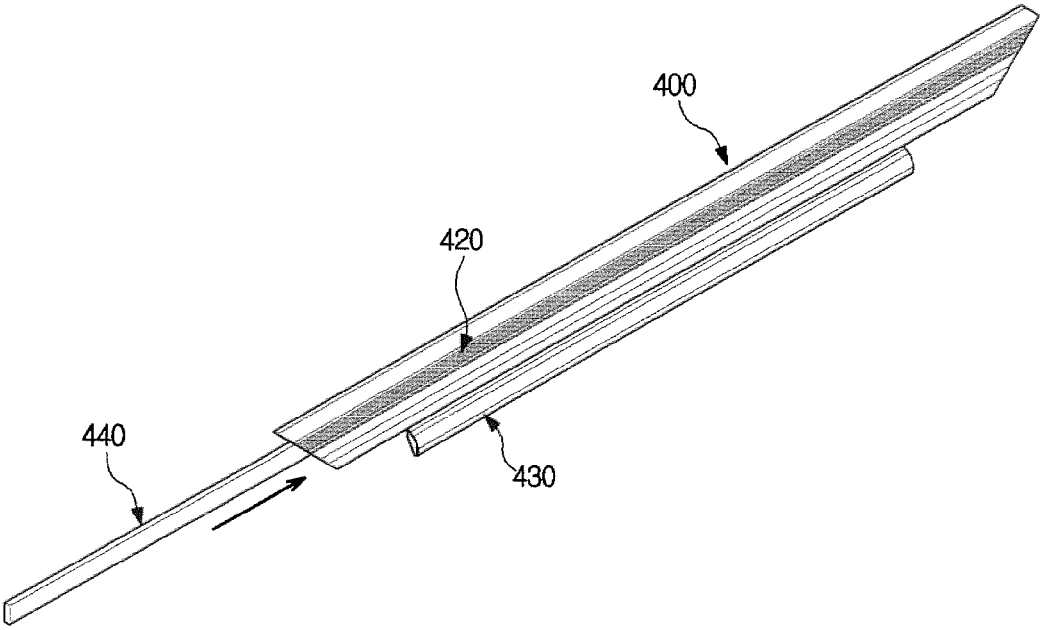
FIG. 33 illustrates a view of a magnet being inserted in FIG. 32 according to one embodiment of the present disclosure.

After a part of both ends of the cool air leakage preventing portion 430 is cut, the magnet 440 is inserted into the magnet accommodation portion 425 of the close contact portion 420, as illustrated in FIG. 33.

Figure 34:
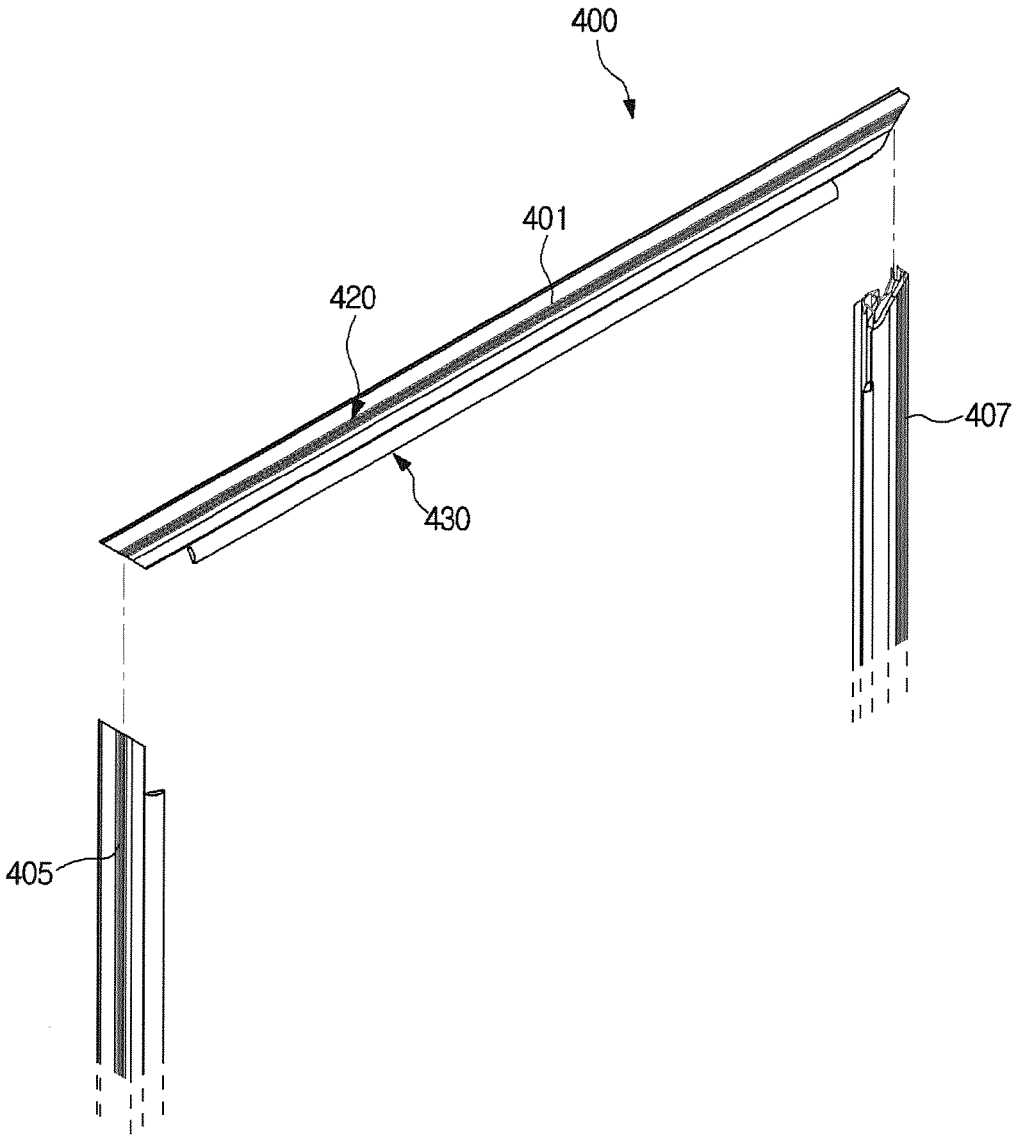
FIG. 34 illustrates a view of the gasket of FIG. 33 being thermally bonded in a quadrangular shape corresponding to the edges of the rear surface of the freezer compartment door assembly according to one embodiment of the present disclosure.

As illustrated in FIG. 34, when the magnet 440 is inserted into the close contact portion 420, each of the gaskets 400 is bonded by the thermal bonding to form the quadrangular shape and then coupled to the rear surface of the freezer compartment door assembly 100.

According to the embodiments of the present disclosure, the moisture penetration into the display unit can be prevented, and the generation of the moisture on the front surface of the display unit can be prevented or minimized, while insulation thickness of the portion of the refrigerator compartment door at which the display unit is provided can be thin.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a main body;

a storage compartment inside the main body so that a front surface thereof is opened;

a door assembly rotatably coupled to the main body to open and close the opened front surface of the storage compartment and including an opening provided at a front surface thereof; and a display unit provided at the door assembly, wherein the display unit comprises:

a display installation part that is inside the door assembly to correspond to the opening and at which a display is installed, wherein the display installation part comprises a protruding rib, a displaying part that is disposed at a front surface of the display installation part and exposed to an outside through the opening, wherein the displaying part comprises a seating groove that corresponds to the protruding rib, and a sealing member that is seated in the seating groove and configured to:

seal between the display installation part and the displaying part, and prevent moisture from penetrating into the display unit, wherein when the display installation part and the displaying part are coupled to a coupling portion, the protruding rib is configured to press the sealing member while being inserted into the seating groove, and the sealing member is configured to seal between the protruding rib and the seating groove.

2. The refrigerator according to claim 1, wherein the door assembly comprises a door plate that forms a front surface and side surfaces of the door plate and a rear plate that forms a rear surface of the door plate, and an insulation material is filled between the door plate and the rear plate.

3. The refrigerator according to claim 2, wherein the opening is provided at a front surface of the door plate, and the coupling portion that is bent toward an inside of the door plate and to which the display installation part and the displaying part are coupled is provided at an edge of the opening.

4. The refrigerator according to claim 3, wherein the display installation part comprises a plurality of coupling ribs that is coupled to the coupling portion, and a close contact portion that is in close contact with a rear surface of the door plate and is configured to prevent the insulation material from penetrating into the display installation part.

5. The refrigerator according to claim 4, wherein the plurality of coupling ribs are provided at both sides of the display installation part, and a plurality of first coupling holes to which the plurality of coupling ribs are coupled are provided at both side surfaces of the coupling portion.

6. The refrigerator according to claim 5, wherein the displaying part further comprises a plurality of coupling hooks that are coupled to the coupling portion.

7. The refrigerator according to claim 6, wherein the coupling hook comprises a first coupling hook that is provided at each of upper and lower portions of the displaying part and a plurality of second coupling hooks that are provided at both side surfaces of the displaying part.

8. The refrigerator according to claim 7, wherein the first coupling hook is coupled to upper and lower portions of the coupling portion, and a plurality of second coupling holes to which the second coupling hooks are coupled are provided at both side surfaces of the coupling portion.

9. A display unit that is provided in combination with a door assembly for opening and closing a storage compartment of a refrigerator, comprising:

a display installation part provided inside the door assembly and at which a display is installed, wherein the display installation part comprises a protruding rib;

a displaying part disposed at a front surface of the display installation part to be exposed to a front surface of the door assembly, wherein the displaying part comprises a seating groove that corresponds to the protruding rib; and a sealing member that is seated in the seating groove and configured to:

seal between the display installation part and the displaying part and prevent moisture from penetrating into the display unit, wherein when the display installation part and the displaying part are coupled to a coupling portion, the protruding rib is configured to press the sealing member while being inserted into the seating groove, and the sealing member is configured to seal between the protruding rib and the seating groove.

10. The display unit according to claim 9, wherein the door assembly comprises a door plate that comprises a front plate including an opening and a side plate that is bent backward from the front surface, and a rear plate that forms a rear surface of the door plate, and the display installation part and the displaying part are coupled to the coupling portion provided at an edge of the opening.

11. The display unit according to claim 10, wherein the display installation part comprises a plurality of coupling ribs that are coupled to the coupling portion and a close contact portion that is in close contact with a rear surface of the front plate and is configured to prevent an insulation material filled in the door assembly from penetrating into the display installation part.

12. The display unit according to claim 11, wherein the plurality of coupling ribs are provided at both sides of the display installation part, and a plurality of first coupling holes to which the plurality of coupling ribs are coupled are provided at both side surfaces of the coupling portion.

13. The display unit according to claim 12, wherein the displaying part comprises a plurality of coupling hooks that are exposed to an outside through the opening and coupled to the coupling portion.

14. The display unit according to claim 13, wherein the coupling hook comprises a first coupling hook that is provided at each of upper and lower portions of the displaying part and a plurality of second coupling hooks that are provided at both side surfaces of the displaying part.

15. The display unit according to claim 14, wherein the first coupling hook is coupled to upper and lower portions of the coupling portion, and a plurality of second coupling holes to which the second coupling hooks are coupled are provided at both side surfaces of the coupling portion.

* * * * *